US010525747B2

(12) United States Patent
Inoue et al.

(10) Patent No.: US 10,525,747 B2
(45) Date of Patent: Jan. 7, 2020

(54) TAPE AND TAPE CASSETTE

(71) Applicant: Brother Kogyo Kabushiki Kaisha, Nagoya-shi, Aichi-ken (JP)

(72) Inventors: Harumitsu Inoue, Toki (JP); Haruki Matsumoto, Nagoya (JP); Takaaki Banno, Nagoya (JP); Yukiko Takami, Inazawa (JP); Yukihiko Sato, Nagoya (JP); Takaaki Oguchi, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/940,543

(22) Filed: Mar. 29, 2018

(65) Prior Publication Data

US 2019/0061394 A1 Feb. 28, 2019

(30) Foreign Application Priority Data

Aug. 31, 2017 (JP) ..... 2017-167711

(51) Int. Cl.

| | |
|---|---|
| ***B41J 32/00*** | (2006.01) |
| ***B41J 15/04*** | (2006.01) |
| ***B41J 3/407*** | (2006.01) |
| ***B41J 32/02*** | (2006.01) |
| ***B41J 2/325*** | (2006.01) |

(Continued)

(52) U.S. Cl.

CPC ..... *B41J 15/044* (2013.01); *B31D 1/026* (2013.01); *B41J 2/325* (2013.01); *B41J 3/4075* (2013.01); *B41J 32/02* (2013.01); *G09F 3/0288* (2013.01)

(58) Field of Classification Search

None

See application file for complete search history.

(56) References Cited

U.S. PATENT DOCUMENTS

| | | | | |
|---|---|---|---|---|
| 6,134,016 | A | 10/2000 | Watanabe et al. | |
| 6,290,262 | B1 * | 9/2001 | Petkovsek | G09F 3/0288 229/300 |
| 2010/0129583 | A1 | 5/2010 | Hong et al. | |

(Continued)

FOREIGN PATENT DOCUMENTS

| | | | |
|---|---|---|---|
| JP | H08-090841 | A | 4/1996 |
| JP | H08-290618 | A | 11/1996 |

(Continued)

*Primary Examiner* — Matthew Luu
*Assistant Examiner* — Tracey M McMillion
(74) *Attorney, Agent, or Firm* — Banner & Witcoff, Ltd.

(57) ABSTRACT

A tape includes: a sheet; first and second media; a first separating line located between first and second media of one pair and extending between first and second ends of the sheet in a widthwise direction; a first cutting portion formed through the first medium and extending from a first end of the first medium to a first endpoint; a second cutting portion formed through the second medium and extending from a first end of the second medium to a second endpoint; and second and third separating lines extending in a longitudinal direction between the first endpoint and a first-medium end portion and between the second endpoint and a second-medium end portion, respectively. A side of the first endpoint on which the first-medium end portion is located is identical in the longitudinal direction to a side of the second endpoint on which the second-medium end portion is located.

13 Claims, 10 Drawing Sheets

(51) Int. Cl.
*G09F 3/00* (2006.01)
*B31D 1/02* (2006.01)

(56) References Cited

U.S. PATENT DOCUMENTS

2010/0166477 A1* 7/2010 Yamaguchi ..... B41J 11/009
400/613
2011/0126439 A1* 6/2011 Liu ..... G09F 3/0292
40/638

FOREIGN PATENT DOCUMENTS

JP H10-058757 A 3/1998
JP 2006-315414 A 11/2006
JP 2007-041016 A 2/2007
JP 5723411 B2 5/2015

* cited by examiner

TAPE AND TAPE CASSETTE

CROSS REFERENCE TO RELATED APPLICATION

The present application claims priority from Japanese Patent Application No. 2017-167711, which was filed on Aug. 31, 2017, the disclosure of which is herein incorporated by reference in its entirety.

BACKGROUND

The following disclosure relates to a tape and a tape cassette.

There is known a printing apparatus configured to, in a case where the printing apparatus prints on a strip-shaped print tape an image having a width greater than that of the print tape, split print data for image printing into a plurality of partial data and print images on a plurality of portions of the print tape in its longitudinal direction based on the plurality of the created partial data. After the printing apparatus performs printing on the print tape based on the plurality of the partial data, the portions of the print tape which correspond to the respective partial data are stuck to each other by a user with respect to positioning marks.

In the case where a plurality of print tapes are stuck to each other, accurate positioning is preferable. The above-described conventional printing apparatus enables positioning with respect to the marks, but when the user sticks the print tapes to each other, the user needs to perform positioning of the print tapes in a state in which the entire release paper is peeled off. Thus, adhesive portions of the print tapes different from its sticking regions may adhere to user's hand or an object, leading to low workability in sticking.

Accordingly, an aspect of the disclosure relates to a tape and a tape cassette with improved workability in sticking of a plurality of media to each other in a case where an image wider than a medium stuck to a strip-shaped sheet is split into a plurality of portions each having a width less than the width of the medium and is printed on the medium.

One aspect of the disclosure relates to a tape comprising: a sheet having a strip shape; a plurality of pairs of first media and second media, each of the plurality of pairs comprising a first medium and a second medium arranged adjacent to each other in a longitudinal direction of the sheet, the first medium and the second medium being spaced apart from each other in the longitudinal direction, the first medium and the second medium being peelably stuck to the sheet; a first separating line formed at a portion of the sheet which is located between the first medium and the second medium of one pair of the plurality of pairs of the first media and the second media, the first separating line extending, in a widthwise direction orthogonal to the longitudinal direction, over at least a portion of a region extending in the widthwise direction from a first end of the sheet in the widthwise direction to a second end of the sheet in the widthwise direction, the first separating line comprising a portion formed through or cut in the sheet in a thickness direction of the sheet, the first medium comprising a first end and a second end in the widthwise direction, the first end of the first medium in the widthwise direction being nearer in the widthwise direction to the first end of the sheet in the widthwise direction than the second end of the first medium in the widthwise direction, the second medium comprising a first end and a second end in the widthwise direction, the first end of the second medium in the widthwise direction being nearer in the widthwise direction to the first end of the sheet in the widthwise direction than the second end of the second medium in the widthwise direction; a first cutting portion formed through the first medium and extending from the first end of the first medium in the widthwise direction to a first endpoint located between the first end of the first medium in the widthwise direction and a center position of the first medium in the widthwise direction; a second cutting portion formed through the second medium and extending from the first end of the second medium in the widthwise direction to a second endpoint located between the first end of the second medium in the widthwise direction and a center position of the second medium in the widthwise direction, the second endpoint and the first cutting portion being equidistant in the longitudinal direction from a center position of the portion of the sheet in the longitudinal direction, which portion is located between the first medium and the second medium of the one pair; a second separating line provided at a first portion of the sheet to which the first medium is stuck, the second separating line being located in the widthwise direction between the center position of the first medium in the widthwise direction and the first end of the first medium in the widthwise direction, the second separating line being at least extending in the longitudinal direction between the first endpoint and a first-medium end portion that is one of a first end and a second end of the first medium in the longitudinal direction, the second separating line comprising a portion formed through or cut in the sheet in the thickness direction; and a third separating line provided at a second portion of the sheet to which the second medium is stuck, the third separating line being located in the widthwise direction between the center position of the second medium in the widthwise direction and the first end of the second medium in the widthwise direction, the third separating line at least extending in the longitudinal direction between the second endpoint and a second-medium end portion that is one of a first end and a second end of the second medium in the longitudinal direction, wherein a side, with respect to the first endpoint, on which the first-medium end portion is located in the longitudinal direction is identical to a side, with respect to the second endpoint, on which the second-medium end portion is located in the longitudinal direction, the third separating line comprising a portion formed through or cut in the sheet in the thickness direction.

Another aspect of the disclosure relates to a tape comprising: a sheet having a strip shape; a plurality of pairs of first media and second media, each of the plurality of pairs comprising a first medium and a second medium arranged adjacent to each other in a longitudinal direction of the sheet, the first medium and the second medium being spaced apart from each other in the longitudinal direction, the first medium and the second medium being peelably stuck to the sheet; a first separating line formed at a portion of the sheet which is located between the first medium and the second medium of one pair of the plurality of pairs of the first media and the second media, the first separating line extending, in a widthwise direction orthogonal to the longitudinal direction, over at least a portion of a region extending in the widthwise direction from a first end of the sheet in the widthwise direction to a second end of the sheet in the widthwise direction, the first separating line comprising a portion formed through or cut in the sheet in a thickness direction of the sheet, the first medium comprising a first end and a second end in the widthwise direction, the first end of the first medium in the widthwise direction being nearer in the widthwise direction to the first end of the sheet in the widthwise direction than the second end of the first medium in the widthwise direction, the second medium comprising a first end and a second end in the widthwise direction, the second end of the second medium in the widthwise direction being nearer in the widthwise direction to the second end of the sheet in the widthwise direction than the first end of the second medium in the widthwise direction; a first cutting portion formed through the first medium and extending from the first end of the first medium in the widthwise direction to a first endpoint located between the first end of the first medium in the widthwise direction and a center position of the first medium in the widthwise direction; a second cutting portion formed through the second medium and extending from the second end of the second medium in the widthwise direction to a second endpoint located between the second end of the second medium in the widthwise direction and a center position of the second medium in the widthwise direction, the second endpoint being located in the longitudinal direction such that a sum of (i) a distance between the first endpoint and one of a first end and a second end of the first medium in the longitudinal direction, which one is nearer to the first separating line than the other, and (ii) a distance between the second endpoint and one of a first end and a second end of the second medium in the longitudinal direction, which one is nearer to the first separating line than the other, is equal to a length of the second medium in the longitudinal direction; a second separating line provided at a first portion of the sheet to which the first medium is stuck, the second separating line being located in the widthwise direction between the center position of the first medium in the widthwise direction and the first end of the first medium in the widthwise direction, the second separating line being at least extending in the longitudinal direction between the first endpoint and a first-medium end portion that is the one of the first end and the second end of the first medium in the longitudinal direction, the second separating line comprising a portion formed through or cut in the sheet in the thickness direction; and a third separating line provided at a second portion of the sheet to which the second medium is stuck, the third separating line being located in the widthwise direction between the center position of the second medium in the widthwise direction and the second end of the second medium in the widthwise direction, the third separating line at least extending in the longitudinal direction between the second endpoint and a second-medium end portion that is the one of the first end and the second end of the second medium in the longitudinal direction, wherein a side, with respect to the first endpoint, on which the first-medium end portion is located in the longitudinal direction is opposite to a side, with respect to the second endpoint, on which the second-medium end portion is located in the longitudinal direction, the third separating line comprising a portion formed through or cut in the sheet in the thickness direction.

Still another aspect of the disclosure relates to a tape cassette comprising: a tape roll comprising (a) a spool and (b) a tape wound around the spool, the tape comprising (i) a sheet having a strip shape, (ii) a plurality of pairs of first media and second media, each of the plurality of pairs comprising a first medium and a second medium arranged adjacent to each other in a longitudinal direction of the sheet, the first medium and the second medium being spaced apart from each other in the longitudinal direction, the first medium and the second medium being peelably stuck to the sheet, (iii) a first separating line formed at a portion of the sheet which is located between the first medium and the second medium of one pair of the plurality of pairs of the first media and the second media, the first separating line extending, in a widthwise direction orthogonal to the longitudinal direction, over at least a portion of a region extending in the widthwise direction from a first end of the sheet in the widthwise direction to a second end of the sheet in the widthwise direction, the first separating line comprising a portion formed through or cut in the sheet in a thickness direction of the sheet, the first medium comprising a first end and a second end in the widthwise direction, the first end of the first medium in the widthwise direction being nearer in the widthwise direction to the first end of the sheet in the widthwise direction than the second end of the first medium in the widthwise direction, the second medium comprising a first end and a second end in the widthwise direction, the first end of the second medium in the widthwise direction being nearer in the widthwise direction to the first end of the sheet in the widthwise direction than the second end of the second medium in the widthwise direction, (iv) a first cutting portion formed through the first medium and extending from the first end of the first medium in the widthwise direction to a first endpoint located between the first end of the first medium in the widthwise direction and a center position of the first medium in the widthwise direction, (v) a second cutting portion formed through the second medium and extending from the first end of the second medium in the widthwise direction to a second endpoint located between the first end of the second medium in the widthwise direction and a center position of the second medium in the widthwise direction, the second endpoint and the first cutting portion being equidistant in the longitudinal direction from a center position of the portion of the sheet in the longitudinal direction, which portion is located between the first medium and the second medium of the one pair, (vi) a second separating line provided at a first portion of the sheet to which the first medium is stuck, the second separating line being located in the widthwise direction between the center position of the first medium in the widthwise direction and the first end of the first medium in the widthwise direction, the second separating line being at least extending in the longitudinal direction between the first endpoint and a first-medium end portion that is one of a first end and a second end of the first medium in the longitudinal direction, the second separating line comprising a portion formed through or cut in the sheet in the thickness direction, and (vii) a third separating line provided at a second portion of the sheet to which the second medium is stuck, the third separating line being located in the widthwise direction between the center position of the second medium in the widthwise direction and the first end of the second medium in the widthwise direction, the third separating line at least extending in the longitudinal direction between the second endpoint and a second-medium end portion that is one of a first end and a second end of the second medium in the longitudinal direction, wherein a side, with respect to the first endpoint, on which the first-medium end portion is located in the longitudinal direction is identical to a side, with respect to the second endpoint, on which the second-medium end portion is located in the longitudinal direction, the third separating line comprising a portion formed through or cut in the sheet in the thickness direction; a ribbon roll that is a roll of an ink ribbon to be used for printing on the tape roll; and a housing that houses the tape roll and the ribbon roll.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

DETAILED DESCRIPTION OF THE EMBODIMENT

Figure 1:
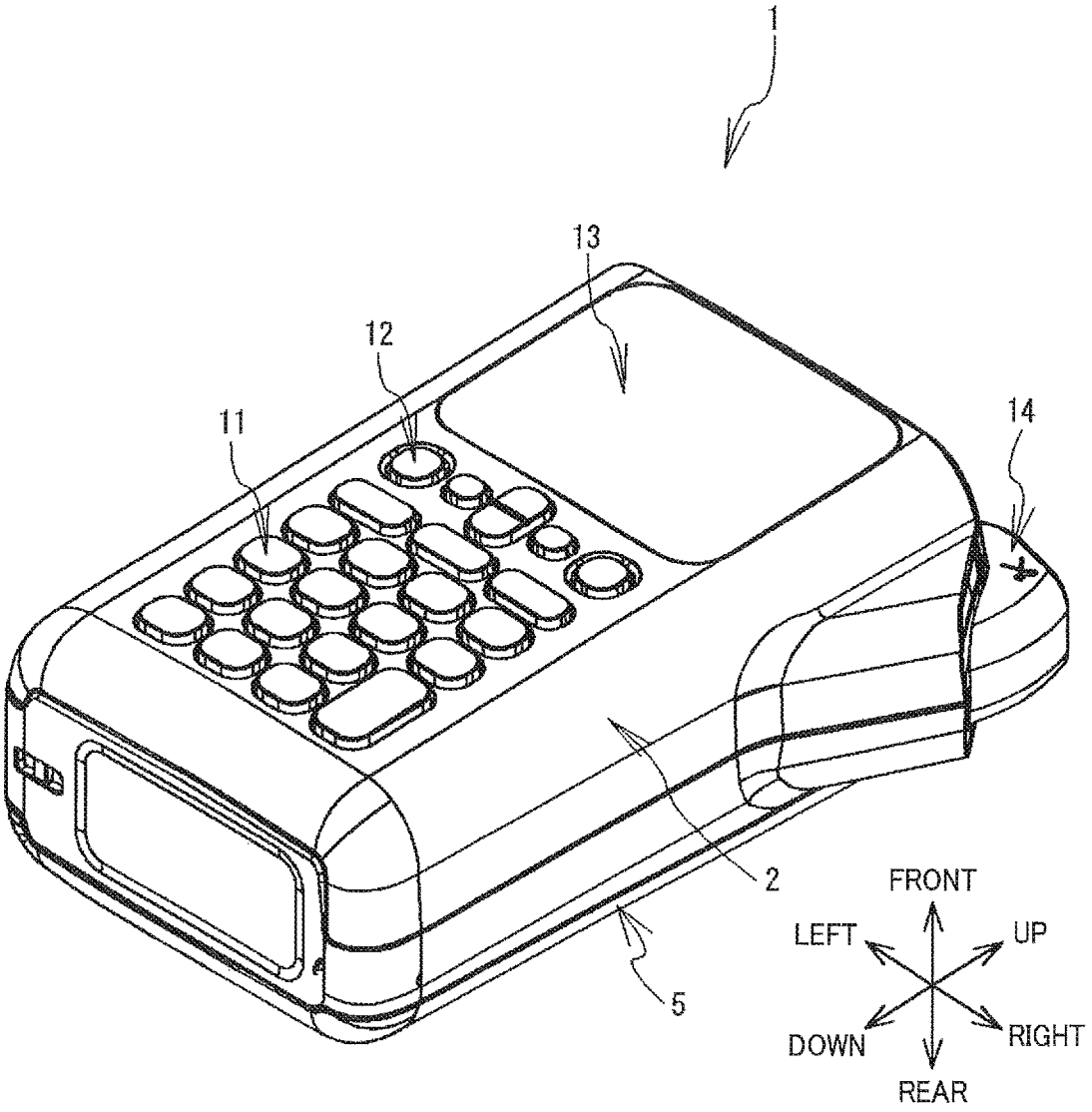
FIG. 1 is a perspective view of a printing apparatus.

Hereinafter, there will be described one embodiment by reference to the drawings. The drawings are for explanation of technical features employable in the present disclosure. It is to be understood that the configuration illustrated in the drawings does not limit the present disclosure and is only one example.

Overall Configuration of Printing Apparatus

There will be described overall configurations of a printing apparatus 1 and a tape cassette 6 according to the present embodiment with reference to FIGS. 1-4. The upper side, the lower side, the lower right side, the upper left side, the upper right side, and the lower left side in FIG. 1 are defined as a front side, a rear side, a right side, a left side, an upper side, and a lower side of the printing apparatus 1, respectively. The lower side, the upper side, the right side, and the left side in FIG. 4, and the front side and the back side of FIG. 4 are defined as a front side, a rear side, a right side, a left side, an upper side, and a lower side of the tape cassette 6, respectively.

As illustrated in FIG. 1, the printing apparatus 1 has a substantially rectangular parallelepiped shape. The printing apparatus 1 includes a housing 2, a cover 5, a keyboard 11, a function key group 12, a liquid crystal display 13, and a cutting knob 14. The housing 2 and the cover 5 are formed of resin. The housing 2 is shaped like a box having an opening at its rear end portion and having a rectangular shape when viewed from a front side of the housing 2. The cover 5 is openably attached to a rear portion of the housing 2. FIG. 1 illustrates a state in which the cover 5 is closed, and the cover 5 covers an opening formed in the housing 2. The keyboard 11 is provided on a lower side of the center of a front surface of the housing 2. The keyboard 11 is used for input of characters, for example. The function key group 12 is provided on an upper side of the keyboard 11. The function key group 12 is for turning a power source on and off and controlling the printing apparatus 1, for example. The liquid crystal display 13 is provided on an upper side of the function key group 12. The liquid crystal display 13 is configured to display characters and symbols input by a user, for example. The cutting knob 14 is provided at an upper right portion of the housing 2 so as to be movable in a lower left direction. The cutting knob 14 protrudes from the housing 2 toward an upper right side thereof.

Figure 2:
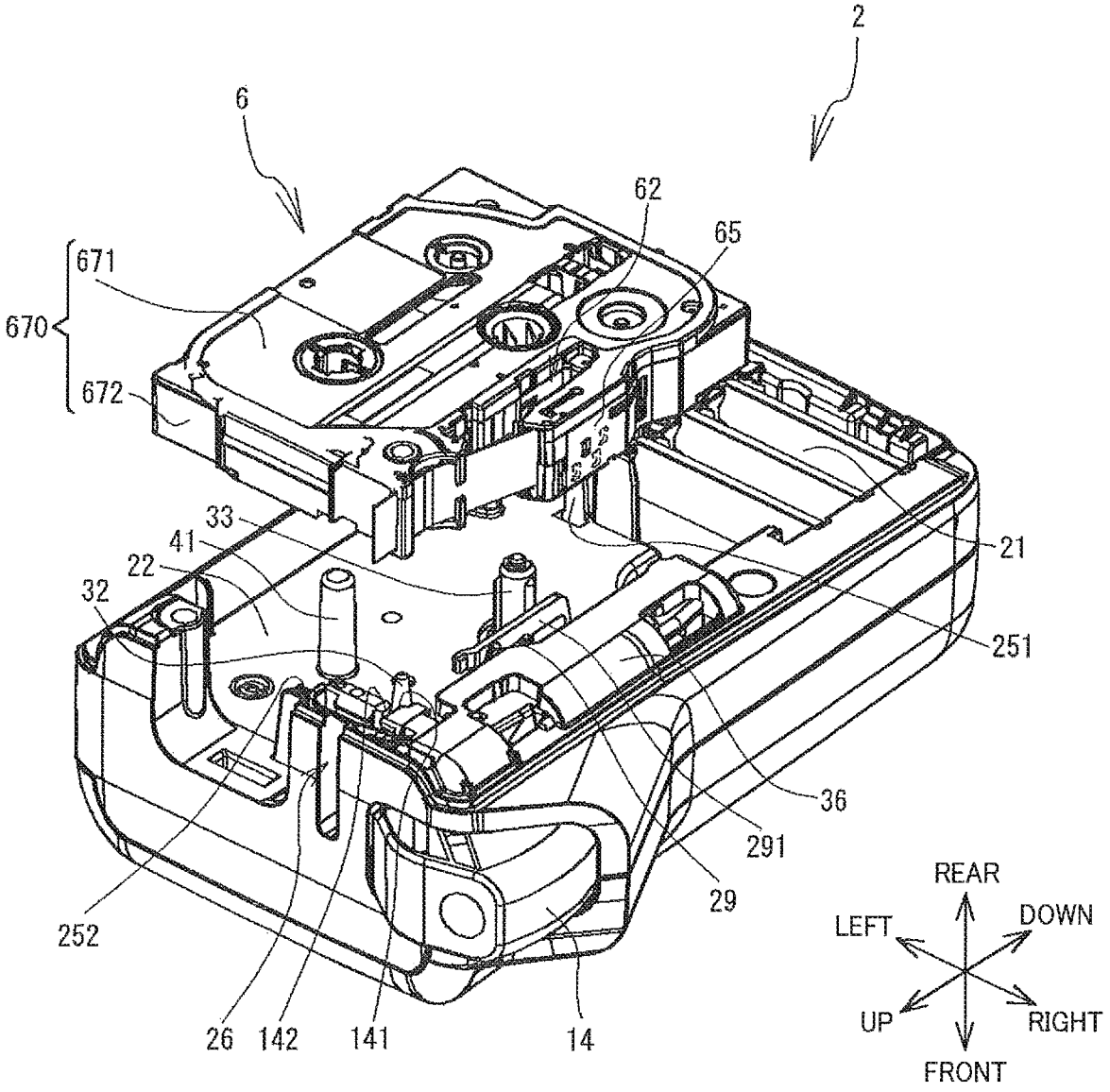
FIG. 2 is a perspective view of the printing apparatus, with a cover opened.
Figure 3:
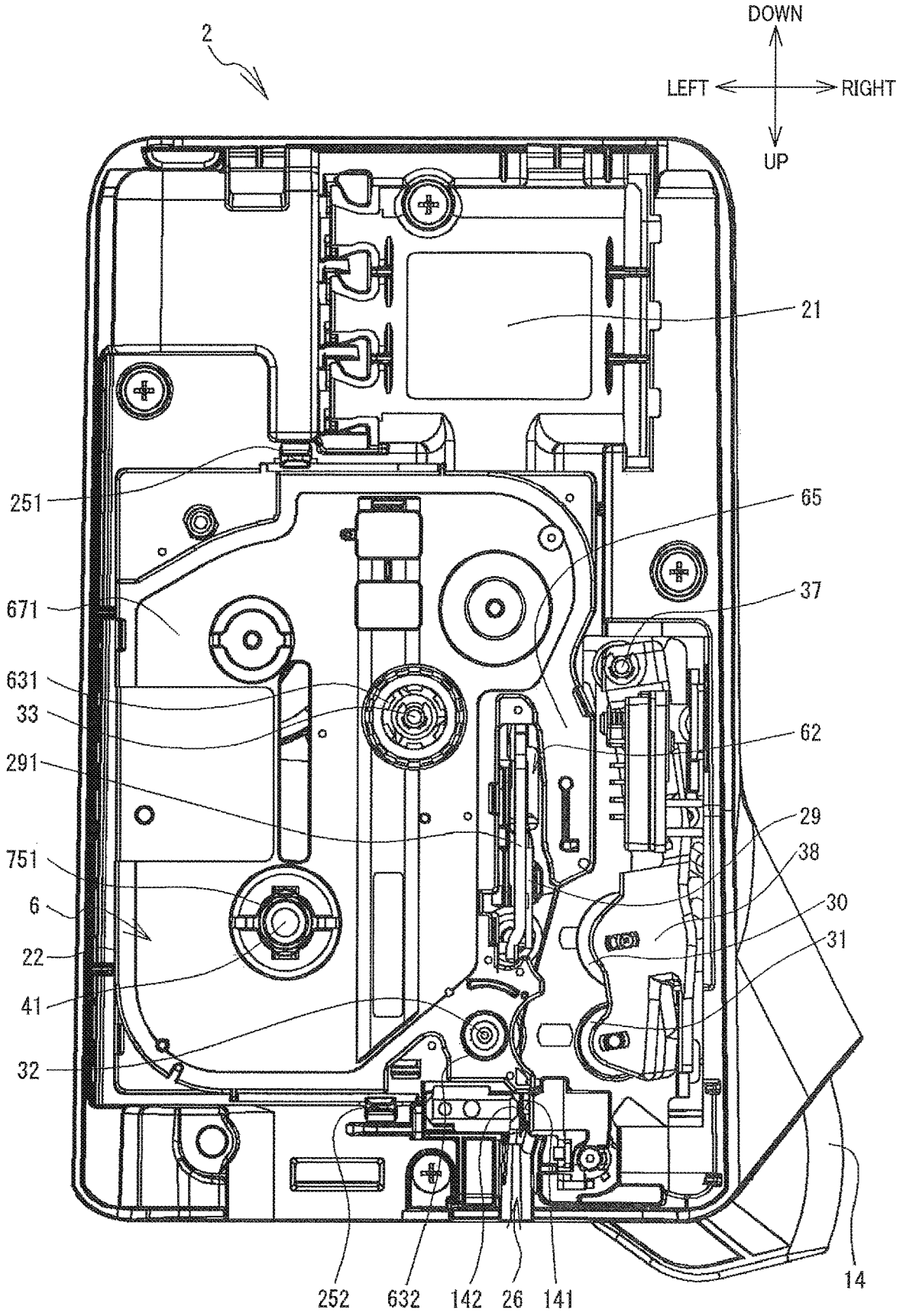
FIG. 3 is a plan view of the printing apparatus, with the cover opened and a protector removed.
Figure 4:
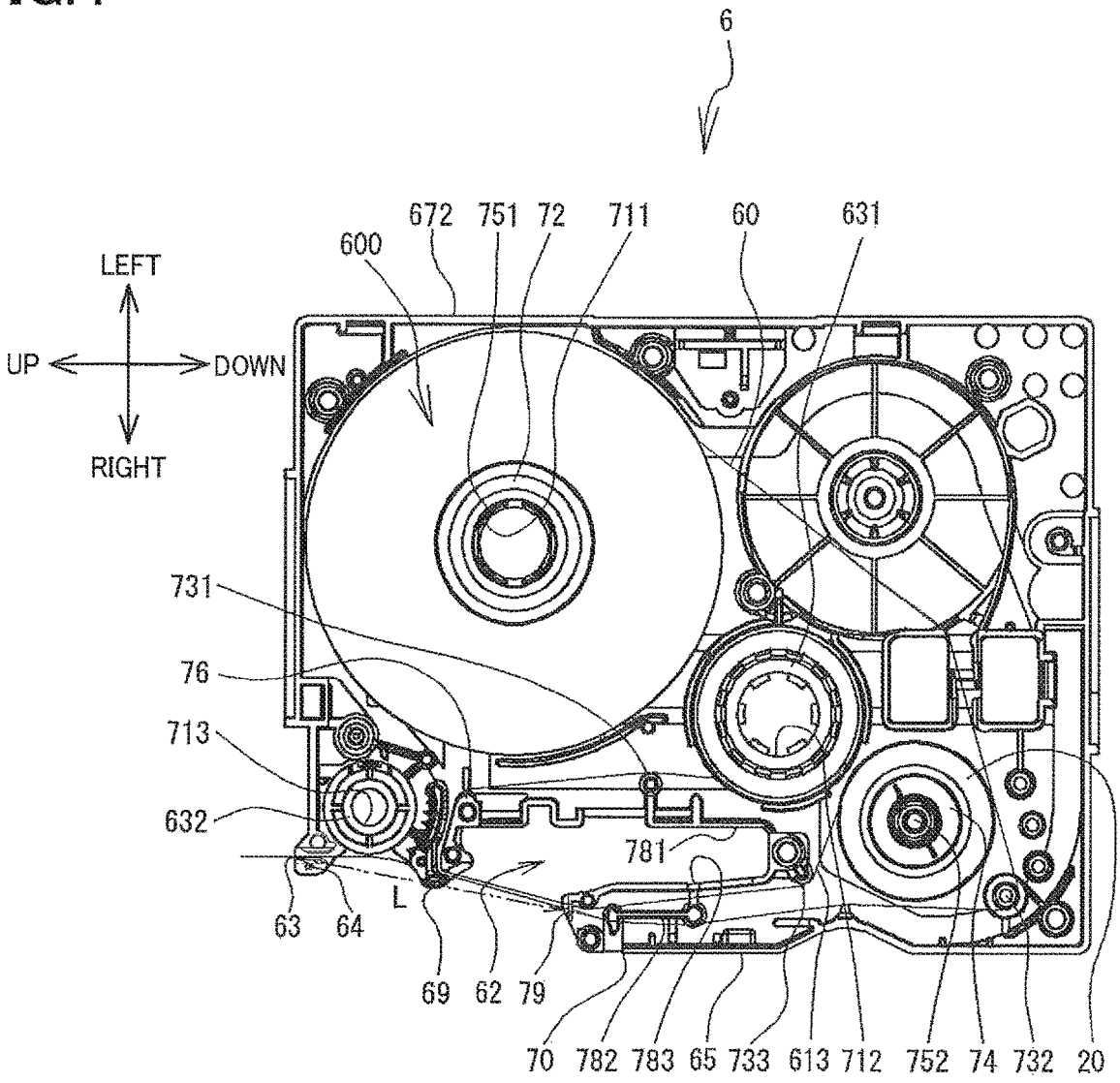
FIG. 4 is a plan view of a tape cassette, with a first casing removed.

As illustrated in FIGS. 2 and 3, the printing apparatus 1 includes a battery holder 21, a cassette holder 22, a platen holder 38, a platen roller 30, a tape sub-roller 31, a protector 36, an output opening 26, a movable blade 141, and a fixed blade 142, which are provided in the housing 2. The battery holder 21 is a recess provided at a portion of the housing 2 which is located on a lower right side of the center of the housing 2. Six batteries are installable in and removable from the battery holder 21.

The cassette holder 22 is a recess located on an upper side of the battery holder 21 and contiguous thereto. The tape cassette 6 is installable in the cassette holder 22 from a rear side thereof. As illustrated in FIG. 3, the cassette holder 22 is provided with a head holder 291, a thermal head 29, a tape-driving-roller shaft 32, a ribbon take-up shaft 33, a positioning boss 41, and hooks 251, 252, for example. The head holder 291 is shaped like a plate extending in the up and down direction and located on a right side of the center of the cassette holder 22 in the right and left direction. The thermal head 29 is provided on a right surface of the head holder 291. The tape-driving-roller shaft 32 is provided on an upper side of the head holder 291 so as to extend in the front and rear direction. The ribbon take-up shaft 33 is provided at substantially the center of the cassette holder 22 so as to extend in the front and rear direction. The ribbon take-up shaft 33 is rotatably fitted in a ribbon take-up spool 631 provided on the tape cassette 6. The ribbon take-up shaft 33 and the tape-driving-roller shaft 32 are rotated such that a tape 60 and an ink ribbon 613 (see FIG. 4) are conveyed at the same speed. The positioning boss 41 is shaped like a circular cylinder provided at an upper left portion of the head holder 291 so as to extend in the front and rear direction. The hook 251 protrudes rearward from a lower end portion of the cassette holder 22. The hook 252 protrudes rearward from an upper end portion of the cassette holder 22. The hooks 251, 252 are engageable with the tape cassette 6 installed on the cassette holder 22.

The platen holder 38 is located to the right of the cassette holder 22 so as to extend in the up and down direction. The platen holder 38 is supported at its lower end portion so as to be pivotable about a pivot shaft 37 extending in the front and rear direction. The platen roller 30 and the tape sub-roller 31 are supported by the platen holder 38 so as to be rotatable in the counterclockwise direction when viewed from a rear side of the platen roller 30 and the tape sub-roller 31. The platen roller 30 is provided to the right of the thermal head 29. The tape sub-roller 31 is provided to the right of the tape-driving-roller shaft 32 and near an upper portion of the platen roller 30. A spring, not illustrated, urges the platen holder 38 such that the platen holder 38 pivots rightward about the pivot shaft 37. As illustrated in FIG. 2, the protector 36 is provided at a rear of the platen holder 38 so as to extend in the up and down direction.

The output opening 26 extends in the down direction from an upper end of the housing 2. The movable blade 141 and the fixed blade 142 are provided on a lower side of the output opening 26 and respectively on opposite sides of a tape conveyance path in the right and left direction. The tape conveyance path is a path through which the tape 60 contained in the tape cassette 6 is conveyed. Cutting edges of the movable blade 141 and the fixed blade 142 face the tape conveyance path. A right portion of the movable blade 141 is in contact with the cutting knob 14. When the cutting knob 14 is pushed toward a lower left side thereof, the movable blade 141 is pushed by the cutting knob 14 and moved toward the fixed blade 142. This operation causes the movable blade 141 to cut the tape 60 located between the movable blade 141 and the fixed blade 142. The printed tape 60 cut by the fixed blade 142 and the movable blade 141 is discharged to the outside of the housing 2 through the output opening 26.

Overall Configuration of Tape Cassette 6

As illustrated in FIG. 2, the tape cassette 6 has a rectangular parallelepiped shape. The shape of the tape cassette 6 is substantially rectangular in plan view. As illustrated in FIG. 4, the tape cassette 6 includes a housing 670, a pair of guides 69, a ribbon separator 76, and an arm 65. The housing 670 contains a tape roll 600 and a ribbon roll 20. The housing 670 includes a first casing 671 and a second casing 672. The second casing 672 is shaped like a box having an opening at its rear end. The first casing 671 is shaped like a plate that closes the opening of the second casing 672.

As illustrated in FIG. 4, the tape cassette 6 includes support holes 711, 712, 713, the tape roll 600, a cassette boss 751, a reel boss 752, the ribbon roll 20, a tape conveying roller 632, guide pins 731, 732, 733, and an output portion 64, which are provided in the second casing 672. The support hole 711 supports a spool 72 for the tape roll 600 such that the spool 72 is rotatable. The tape roll 600 is a roll of the tape 60 wound around the spool 72. The support hole 712 supports the ribbon take-up spool 631. The ribbon take-up spool 631 takes up the ink ribbon 613 from the ribbon roll 20 wound around a spool 74. The cassette boss 751 and the reel boss 752 are provided upright on a lower surface of the second casing 672. The cassette boss 751 supports the spool 72 such that the spool 72 is rotatable. The reel boss 752 supports the spool 74 for the ribbon roll 20 such that the spool 74 is rotatable. The ribbon roll 20 is a roll of the ink ribbon 613 to be used for printing on the tape roll 600. The ink ribbon 613 is wound around the spool 74. The support hole 713 supports the tape conveying roller 632 such that the tape conveying roller 632 is rotatable. The tape conveying roller 632 is rotated with the tape sub-roller 31 (see FIG. 3) to draw the tape 60 from the tape roll 600. The pair of upper and lower guides 69 are provided near a lower right portion of the tape conveying roller 632. The ribbon separator 76 is provided near left portions of the guides 69. The guide pin 731 is provided on an upper right side of the support hole 712 so as to extend in the front and rear direction. The guide pin 731 guides movement of the ink ribbon 613 that had been used for printing. The guide pin 732 is provided on a lower right side of the reel boss 752 so as to extend in the front and rear direction. The guide pin 732 guides movement of the unprinted tape 60. The guide pin 733 is provided on an upper right side of the reel boss 752 so as to extend in the front and rear direction. The guide pin 733 guides movement of the ink ribbon 613 that has not been used for printing. The output portion 64 is provided on an upper right side of the support hole 713 so as to protrude toward an upper right side of the output portion 64. The output portion 64 has an output opening 63. The output opening 63 extends through the output portion 64 in the up and down direction. The width of the output opening 63 in the front and rear direction is greater than or equal to that of the tape 60 in the front and rear direction. The tape 60 exposed to the outside of the housing 670 through an opening 79 which will be described below passes through the output opening 63.

The arm 65 is provided to the right of the guide pin 733 so as to extend upward. The arm 65 has walls 70, 783, 782 and the opening 79. The wall 70 serves as a right surface of the arm 65. The wall 783 is disposed to the left of the wall 70 so as to be substantially parallel with the wall 70. The wall 783 serves as a left surface of the arm 65. The wall 782 is shaped like a thin plate extending in the up and down direction and disposed at a central position between the wall 783 and the wall 70 of the arm 65. The ink ribbon 613 drawn from the ribbon roll 20 and the tape 60 drawn from the tape roll 600 are exposed to the outside of the housing 670 through the opening 79. The ink ribbon 613 and the tape 60 are held between the opening 79 and the guides 69 so as to be exposed to the outside of the tape cassette 6. The opening 79 is formed in an upper end portion of the arm 65 at a position located near an upper portion of the wall 782. A head inserted portion 62 is a recess defined by the wall 783 of the arm 65 and a side wall 781 opposed to the arm 65. The head inserted portion 62 has a U-shape opening at an upper right portion of the head inserted portion 62. In the case where the tape cassette 6 is installed on the cassette holder 22 of the printing apparatus 1, the head holder 291 (see FIG. 3) is inserted into the head inserted portion 62.

Print Procedure

As illustrated in FIGS. 2-4, in the case where the tape cassette 6 is installed on the cassette holder 22 of the printing apparatus 1, the ribbon take-up shaft 33 and the tape-driving-roller shaft 32 are respectively fitted in the ribbon take-up spool 631 and the tape conveying roller 632 provided on the tape cassette 6, and the head holder 291 is inserted in the head inserted portion 62. The positioning boss 41 is fitted in the cassette boss 751. As a result, the tape cassette 6 is pressed into the cassette holder 22 in a state in which the tape cassette 6 is positioned, whereby the tape cassette 6 is installed on the cassette holder 22. After the tape cassette 6 is installed on the cassette holder 22, the cover 5 is closed. In the case where the cover 5 is closed, a roller-holder cam, not illustrated, provided on the cover 5 presses the platen holder 38 leftward. The platen holder 38 pivots leftward against an urging force of the spring, not illustrated.

In the case where the printing apparatus 1 executes a print processing, the tape 60 is conveyed from the spool 72 via the guide pin 732 through an area between the wall 782 and the wall 70 of the arm 65. The ink ribbon 613 is conveyed from the spool 74 via the guide pin 733 through an area between the wall 782 and the wall 783 of the arm 65. The ink ribbon 613 is located to the left of the tape 60 in the arm 65 and between the opening 79 and the output portion 64. The ink ribbon 613 and the tape 60 are arranged one on another in the right and left direction and conveyed from the opening 79 to the head inserted portion 62. The tape 60 and the ink ribbon 613 are then pressed onto the thermal head 29 by the platen roller 30. Heat generated by the thermal head 29 heats the ink ribbon 613 from a left side thereof. As a result, ink is transferred to the tape 60 by heat, so that an image such as characters is printed on the tape 60.

The ink ribbon 613 is separated from the tape 60 by the ribbon separator 76. The separated ink ribbon 613 is conveyed through the guide pin 731 and taken up by the ribbon take-up spool 631. The printed tape 60 from which the ink ribbon 613 is separated by the ribbon separator 76 is conveyed to the tape conveying roller 632 in a state in which upward and downward movement of the printed tape 60 is restricted by the guides 69. The printed tape 60 is then pressed by the tape sub-roller 31 onto the tape conveying roller 632 that is rotated by the tape-driving-roller shaft 32. The printed tape 60 is discharged from the output opening 26 by rotation of the tape conveying roller 632. Tape 60

Figure 5A:
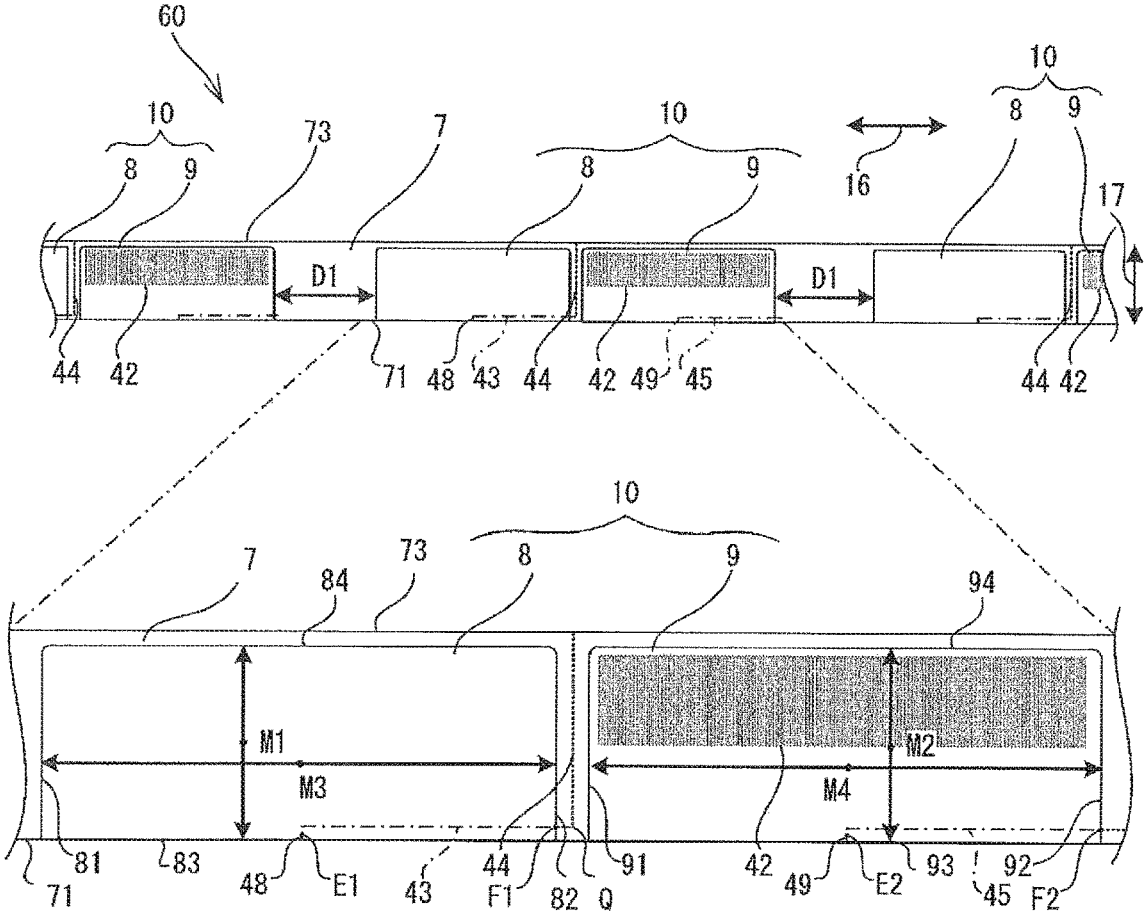
FIG. 5A is a view of a tape, the longitudinal direction of which coincides with the right and left direction in FIG. 5A.

As illustrated in FIG. 5A, the tape 60 includes a strip-shaped sheet 7, a plurality of pairs of first media 8 and second media 9 each as a label, first separating lines 44, first cutting portions (first cuts) 48, second cutting portions (second cuts) 49, second separating lines 43, and third separating lines 45. In the present example, the tape 60 further includes first dividing portions 55 and second dividing portions 56. The media are removably stuck to the sheet 7. In the present example, the sheet 7 is release paper (such as glassine, high-quality paper, or kraft paper) covered with a release agent formed of a silicon-based material, for example. The sheet 7 may be formed of a material other than the release paper. For example, the sheet 7 may be a release film formed of a resin film.

The first medium 8 and the second medium 9 of each pair are arranged adjacent to each other in a longitudinal direction 16 of the sheet 7. The first medium 8 and the second medium 9 are spaced apart from each other in the longitudinal direction 16 and stuck to the sheet 7 such that the first medium 8 and the second medium 9 can be peeled off from the sheet 7. Each of the first medium 8 and the second medium 9 has a rectangular shape extending in the longitudinal direction 16. In the present example, the first medium 8 and the second medium 9 have the same length in the longitudinal direction 16 of the sheet 7 and the same length in a widthwise direction 17 of the sheet 7. Also, the first medium 8 and the second medium 9 have the same shape and the same size. It is noted that the shapes of the first medium 8 and the second medium 9 need not be completely the same as each other and may be substantially the same as each other. This applies to the size of the first medium 8 and the second medium 9. Ground colors of the first medium 8 and the second medium 9 are the same as each other and are white, for example. The ground colors of the first medium 8 and the second medium 9 may be colors other than white (e.g., yellow or black) and may be different from each other. The ground color of each of the first medium 8 and the second medium 9 is not limited to a single color and may include a plurality of colors. A particular pattern may be formed on the first medium 8 and the second medium 9. Each of the first medium 8 and the second medium 9 is a film formed of resin such as PET, PVC, PP, PE, PS, and ABS, for example. Each of the first medium 8 and the second medium 9 has a surface opposed to the sheet 7, and an adhesive layer is provided on this surface. The adhesive layer includes an adhesive formed of an acrylic-based material, for example. The first medium 8 and the second medium 9 are stuck to the sheet 7 by their respective adhesive layers. In the present example, the first medium 8 and the second medium 9 of each pair are located on opposite sides of the first separating line 44 in the longitudinal direction 16. In the present example, the first medium 8 and the second medium 9 are arranged such that one end 71 of the sheet 7 in the widthwise direction 17, one end 83 of the first medium 8 in the widthwise direction 17, and one end 93 of the second medium 9 in the widthwise direction 17 are located at the same position in the widthwise direction 17. Corner portions of the first medium 8 which are nearer to the other end 84 of the first medium 8 in the widthwise direction 17 than the one end 83 are chamfered. Likewise, corner portions of the second medium 9 which are nearer to the other end 94 of the second medium 9 in the widthwise direction 17 than the one end 93 are chamfered.

The second medium 9 has an image 42 extending in the longitudinal direction 16. The image 42 has a rectangular shape. The second medium 9 has one end 93 and the other end 94 in the widthwise direction 17. The image 42 is disposed between the center M2 of the second medium 9 in the widthwise direction 17 and the other end 94 of the second medium 9 in the widthwise direction 17. In the present example, the color of the image 42 is different from the ground color of the second medium 9. For example, in the case where the ground color of the second medium 9 is white, the color of the image 42 is yellow, red, orange, or blue, for example. The image 42 need not be formed in a single color and may include a plurality of colors and/or a pattern, for example. The ink ribbon 613 has ink of a color different from that of the image 42, for example, the ink ribbon 613 has black ink. Specifically, the ink ribbon 613 has a strip shape and includes an ink layer and a substrate. The substrate is formed of polyethylene terephthalate (PET), for example. The ink layer contains a color component and a binder component such as wax and/or resin. In the case where the ink ribbon 613 has black ink, the color component contained in the ink layer is carbon, for example. In the present example, a plurality of pairs 10 of the first media 8 and the second media 9, each as the pair of the first medium 8 and the second medium 9 adjacent to each other in the longitudinal direction 16, are arranged in the longitudinal direction. One of the pairs 10 and another of the pairs 10 which is located next to the one pair 10 are spaced apart from each other in the longitudinal direction 16. In the present example, a portion of the sheet 7 which is located between the one pair 10 and said another pair 10 in the longitudinal direction 16 does not have any through portion (e.g., a through hole or a through opening) or any cut portion formed through or cut in the sheet 7 in its thickness direction. The length L between the opening 79 and the output portion 64 illustrated in FIG. 4 is less than the distance D1 between two of the plurality of pairs of the first media 8 and the second media 9 illustrated in FIG. 5A, which two are adjacent to each other in the longitudinal direction 16 of the sheet 7. The length of each of the first medium 8 and the second medium 9 in the widthwise direction 17 is less than that of the sheet 7 in the widthwise direction 17 in the present example. The sheet 7 has portions exposed to the outside without the first medium 8 or the second medium 9 being stuck to the portions as indicated by the white portions of the sheet 7 in FIG. 5B.

For each pair of the first medium 8 and the second medium 9, the first separating line 44 is located on the sheet 7 between the first medium 8 and the second medium 9 in the longitudinal direction 16 so as to extend between one end 71 and the other end 73 of the sheet 7 in the widthwise direction 17 orthogonal to the longitudinal direction 16. The first separating line 44 includes a portion of the sheet 7 which is cut in the thickness direction or through which holes or the like is formed in the thickness direction. The cut formed in the sheet 7 in the thickness direction does not extend through the sheet 7 in the thickness direction. In the present example, the first separating line 44 extends in the widthwise direction 17 from the second separating line 43 to the other end 73 of the sheet 7 in the widthwise direction 17 but does not extend between the second separating line 43 and the one end 71 of the sheet 7 in the widthwise direction 17. The first separating line 44 and the second separating line 43 intersect each other at an intersection point Q. The intersection point Q is located at one end of the first separating line 44 in the widthwise direction 17. In the present example, the first separating line 44 is perforation formed through the sheet 7 in the thickness direction. That is, the first separating line 44 includes holes formed through the sheet 7 in the thickness direction and spaced uniformly.

The first cutting portion 48 extends from the one end 83 of the first medium 8 in the widthwise direction 17 to a first endpoint E1. The one end 83 of the first medium 8 in the widthwise direction 17 is nearer to the one end 71 of the sheet 7 in the widthwise direction 17 than the center M1 of the first medium 8 in the widthwise direction 17. The first endpoint E1 is located between the one end 83 of the first medium 8 in the widthwise direction 17 and the center M1 of the first medium 8 in the widthwise direction 17. The first cutting portion 48 is formed through the first medium 8. In the present example, the position of the first cutting portion 48 in the longitudinal direction 16 and the position of the center M3 of the first medium 8 in the longitudinal direction 16 are the same as each other. There are no through portions (through holes or the like) or no cut portions formed through or in the sheet 7 in the thickness direction at a region located on an opposite side of the first endpoint E1 from a first end portion F1 in the longitudinal direction 16 on a first portion 85 of the sheet 7. In the present example, the first end portion F1 is the other end 82 of the first medium 8 in the longitudinal direction 16.

The second cutting portion 49 extends from the one end 93 of the second medium 9 in the widthwise direction 17 to a second endpoint E2. The one end 93 of the second medium 9 in the widthwise direction 17 is nearer to the one end 71 of the sheet 7 in the widthwise direction 17 than the center M2 of the second medium 9 in the widthwise direction 17. The second endpoint E2 is located between the one end 93 of the second medium 9 in the widthwise direction 17 and the center M2 of the second medium 9 in the widthwise direction 17. The second cutting portion 49 is a cut which is formed through the second medium 9 and extends so as to have a line shape. In each pair of the first medium 8 and the second medium 9, the second endpoint E2 and the first cutting portion 48 are equidistant in the longitudinal direction 16 from the center of the first medium 8 and the second medium 9 in the longitudinal direction 16, i.e., the center of a region between the first medium 8 and the second medium 9 in the longitudinal direction 16. In the present example, the position of this center in the longitudinal direction 16 and the position of the first separating line 44 in the longitudinal direction 16 are the same as each other. There are no through portions (through holes or the like) or no cut portions formed through or in the sheet 7 in the thickness direction at a region located on an opposite side of the second endpoint E2 from a second end portion F2 in the longitudinal direction 16 on a second portion 95 of the sheet 7. In the present example, the second end portion F2 is the other end 92 of the second medium 9 in the longitudinal direction 16. In the present example, the first endpoint E1 and the second endpoint E2 are located at the same position in the widthwise direction 17 of the sheet 7. The sum of the length of the first cutting portion 48 in the widthwise direction 17 and the length of the second cutting portion 49 in the widthwise direction 17 is equal to the distance D2 from the one end 83 of the first medium 8 in the widthwise direction 17 to the second separating line 43. In the present example, the second separating line 43 and the third separating line 45 are located at the same position in the widthwise direction 17. The length of the first cutting portion 48 in the widthwise direction 17 is equal to the length of the second cutting portion 49 in the widthwise direction 17. That is, each of the length of the first cutting portion 48 in the widthwise direction 17 and the length of the second cutting portion 49 in the widthwise direction 17 is half the distance D2 between the second separating line 43 and the one end 83 of the first medium 8 in the widthwise direction 17.

Figure 5B:
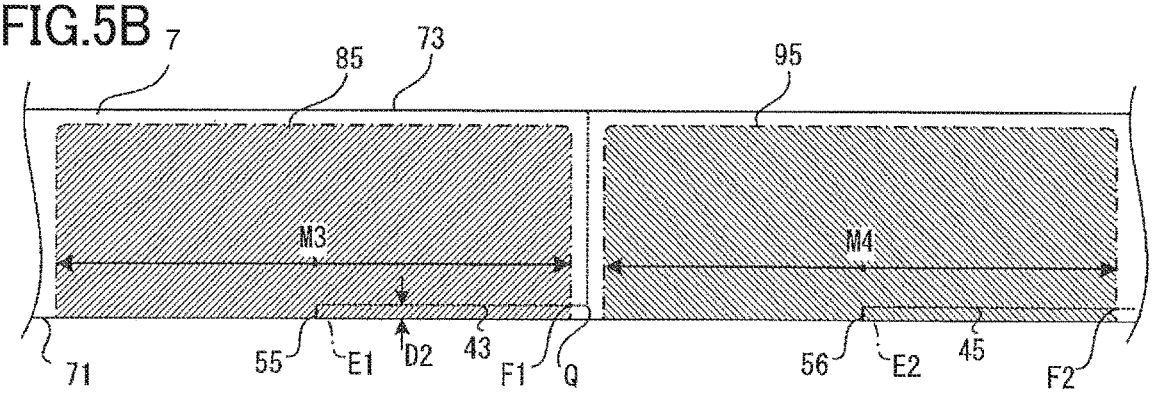
FIG. 5B is a view of a sheet, illustrating its portion to which a first medium had been stuck and its portion to which a second medium had been stuck.

The second separating line 43 includes a portion of the sheet 7 which is cut in the thickness direction or through which holes or the like is formed in the thickness direction. As illustrated in FIG. 5B, the second separating line 43 is provided in the first portion 85 of the sheet 7 to which the first medium 8 is stuck. The second separating line 43 is located in the widthwise direction 17 between the center M1 of the first medium 8 in the widthwise direction 17 and the one end 83 of the first medium 8 in the widthwise direction 17 and extends in the longitudinal direction 16 from the first endpoint E1 to the first end portion F1. In the present example, the second separating line 43 extends in the longitudinal direction 16 from the first endpoint E1 to the first separating line 44. In the tape 60 according to the present example, the first endpoint E1 and the second separating line 43 are spaced apart from each other in the widthwise direction 17. That is, the first endpoint E1 is located in the widthwise direction 17 between the second separating line 43 and the one end 83 of the first medium 8 in the widthwise direction 17. The second separating line 43 is disposed at a distance of greater than or equal to 3 mm in the widthwise direction 17 from the one end 71 of the sheet 7 in the widthwise direction 17. That is, the distance D2 from the one end 71 of the sheet 7 in the widthwise direction 17 to the second separating line 43 in the widthwise direction 17 is greater than or equal to 3 mm.

The third separating line 45 includes a portion of the sheet 7 which is cut in the thickness direction or through which holes or the like is formed in the thickness direction. The third separating line 45 is provided in the second portion 95 of the sheet 7 to which the second medium 9 is stuck. The third separating line 45 is located in the widthwise direction 17 between the center M2 of the second medium 9 in the widthwise direction 17 and the one end 93 of the second medium 9 in the widthwise direction 17. The third separating line 45 extends in the longitudinal direction 16 from the second endpoint E2 to the second end portion F2. The second end portion F2 is one of one end 91 and the other end 92 of the second medium 9 in the longitudinal direction 16. A direction directed from the first endpoint E1 toward the first end portion F1 in the longitudinal direction 16 (i.e., a right direction in FIG. 5A) and a direction directed from the second endpoint E2 toward the second end portion F2 in the longitudinal direction 16 (i.e., a right direction in FIG. 5A) are the same as each other. In other words, a side of the first endpoint E1 on which the first end portion F1 is located in the longitudinal direction 16 (i.e., a right side in FIG. 5A) and a side of the second endpoint E2 on which the second end portion F2 is located in the longitudinal direction 16 (i.e., a right side in FIG. 5A) are the same as each other. In the present example, the length of the third separating line 45 in the longitudinal direction 16 is greater than the distance between the second endpoint E2 and the other end 92 of the second medium 9 in the longitudinal direction 16. In the tape 60 according to the present example, the second endpoint E2 and the third separating line 45 are spaced apart from each other in the widthwise direction 17. Like the second separating line 43, the third separating line 45 is disposed at a distance of greater than or equal to 3 mm in the widthwise direction 17 from the one end 71 of the sheet 7 in the widthwise direction 17.

Each of the first dividing portion 55 and the second dividing portion 56 has a through portion (e.g., through holes or the like) formed through the sheet 7 in the thickness direction of the sheet 7. The position of the first dividing portion 55 in the longitudinal direction 16 and the position of the first endpoint E1 in the longitudinal direction 16 are the same as each other. The first dividing portion 55 extends in the widthwise direction 17 from the second separating line 43 to the one end 71 of the sheet 7 in the widthwise direction 17. The position of the second dividing portion 56 in the longitudinal direction 16 and the position of the second endpoint E2 in the longitudinal direction 16 are the same as each other. The second dividing portion 56 extends in the widthwise direction 17 from the third separating line 45 to the one end 71 of the sheet 7 in the widthwise direction 17. Each of the first dividing portion 55 and the second dividing portion 56 is perforation or a cut, for example. Like the first cutting portion 48 and the second cutting portion 49, each of the first dividing portion 55 and the second dividing portion 56 in the present example is a cut which is formed through the sheet 7 and extends so as to have a line shape.

Figure 5C:
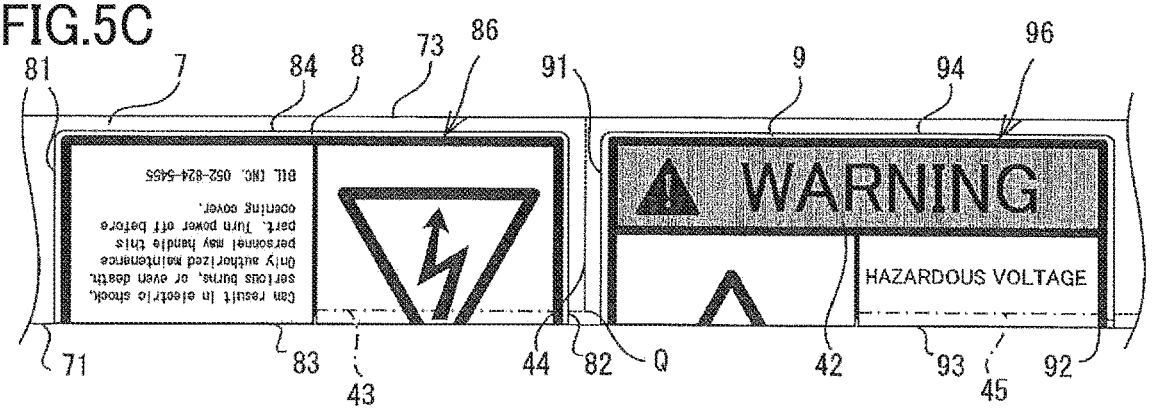
FIG. 5C is a view of the tape with images printed on the first medium and the second medium.

The first media 8 and the second media 9 are incorporated in the tape cassette 6 installed on the printing apparatus 1. As illustrated in FIG. 5C, for example, an image 86 is printed on each of the first media 8, and an image 96 is printed on the second medium 9. The images 86, 96 are formed by dividing an original image having a length greater than that of the first medium 8 and the second medium 9 in the widthwise direction 17. Each of the images 86, 96 is less than or equal to a corresponding one of the media 8, 9 in length in the widthwise direction 17. One example of the original image is a warning image used in a factory. Data for printing of the images 86, 96 is created by the printing apparatus 1 in a well-known manner.

Method of Manufacturing Tape 60

A strip-shaped medium is stuck to a surface of the sheet 7. The medium stuck to the sheet 7 is cut into shapes of the first media 8 and the second media 9 of the plurality of pairs. In this cutting, the sheet 7 is not cut, that is, half cut (kiss cut) is not performed. A portion of the medium which is different from the first media 8 and the second media 9 is peeled off and removed from the sheet 7. The first separating line 44, the second separating line 43, and the third separating line 45 are formed in the sheet 7. In this operation, the first medium 8 and the second medium 9 are not processed. The sheet 7 and the first medium 8 are cut to form the first cutting portion 48 and the first dividing portion 55. The sheet 7 and the second medium 9 are cut to form the second cutting portion 49 and the second dividing portion 56. The image 42 is then formed on the second medium 9. The order of these operations may be changed as needed.

Method of Sticking First Medium 8 and Second Medium 9

There will be next explained a procedure of sticking the image-printed first medium 8 and second medium 9 to each other in the widthwise direction 17, with reference to FIGS. 5A-6C. FIG. 5C illustrates one example in which the image 86 and the image 96 are printed on the first medium 8 and the second medium 9 by the printing apparatus 1, respectively, and the tape 60 is cut at a position between the printed first medium 8 and the second medium 9 of the next pair based on an operation of the cutting knob 14. The image 86 and the image 96 are oriented in opposite directions, respectively. After printing on the first medium 8 and the second medium 9, the user operates the cutting knob 14 to cut the sheet 7 at a position located between the printed first medium 8 and the second medium 9 of the next pair in the longitudinal direction 16. In the printed first medium 8 and the printed second medium 9, the user separates the sheet 7 along the first separating line 44 and then separates the sheet 7 in its thickness direction along the first dividing portion 55 and the second separating line 43 that is located at the first portion 85 and intersects the first separating line 44 at the intersection point Q. The user separates the sheet 7 along the third separating line 45 and the second dividing portion 56 in the second portion 95. The order of these separating operations may be changed as needed.

Figure 6A:
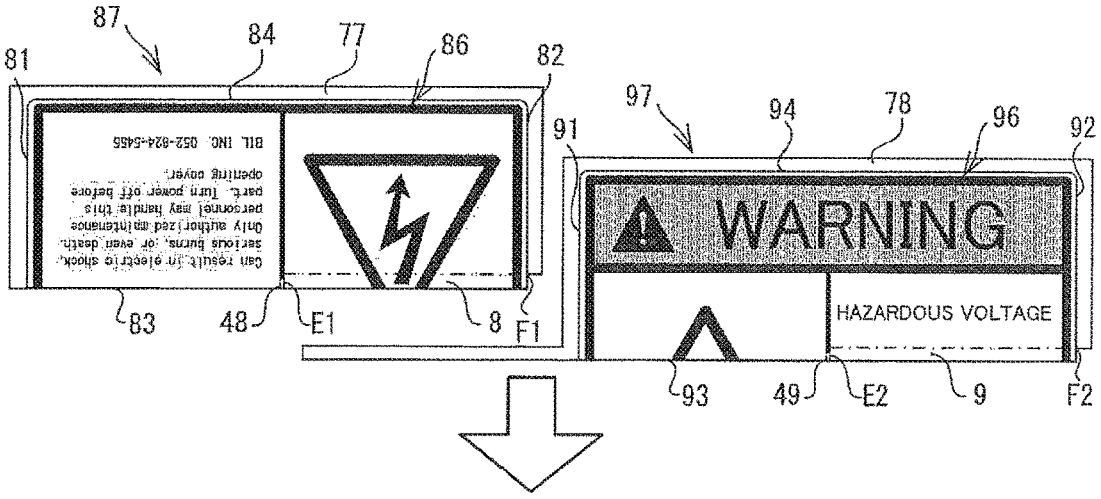
FIG. 6A is a view of tapes into which the printed tape is separated along a first separating line, a second separating line, and a third separating line.
Figure 6B:
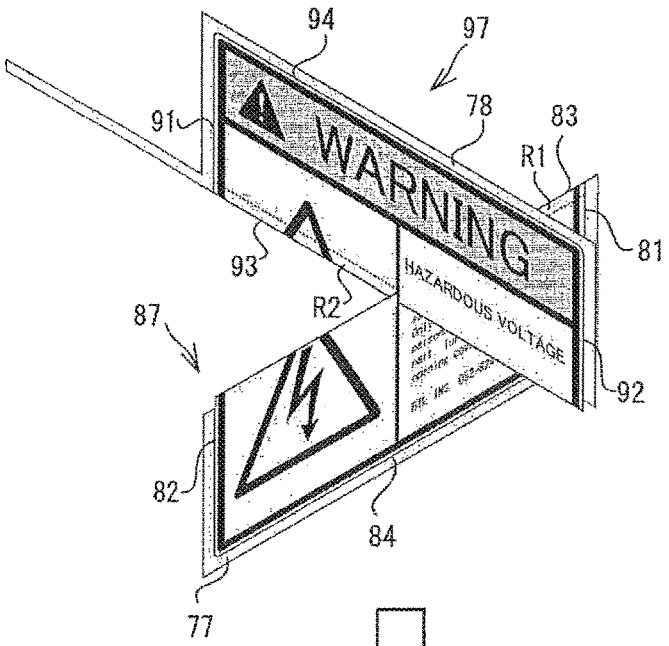
FIG. 6B is a view of the separated tape, illustrating a state in which a first cutting portion of the first medium and a second cutting portion of the second medium are engaged with each other.
Figure 6C:
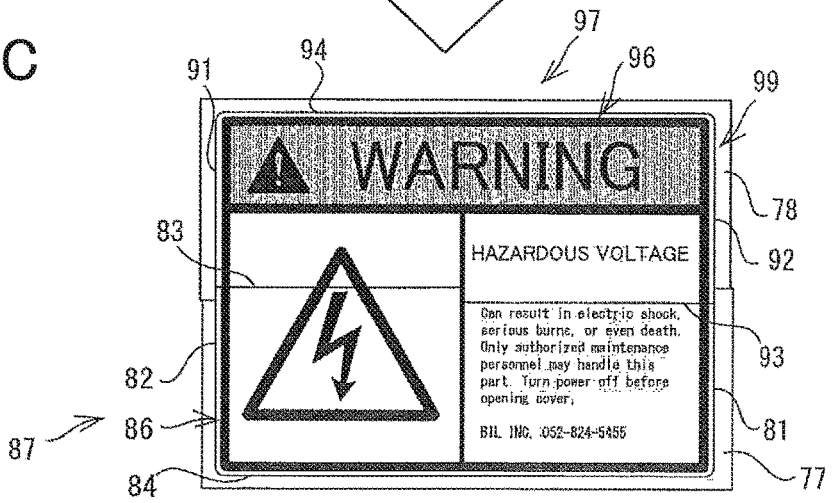
FIG. 6C is a view of the first medium and the second medium stuck to each other in a widthwise direction.

These operations, as illustrated in FIG. 6A, separate the tape 60 into a tape 87 including the printed first medium 8 and a tape 97 including the printed second medium 9. The tape 87 includes a partial sheet 77 and the first medium 8, specifically. The partial sheet 77 is a rectangular portion of the sheet 7 which includes the portion 85. The tape 97 includes a partial sheet 78 and the second medium 9, specifically. Since a portion of the sheet 7 is separated along the longitudinal direction 16 at a region located near the one end 83 of the first medium 8 in the widthwise direction 17 and extending from the first endpoint E1 to the first end portion F1 in the longitudinal direction 16, the adhesive layer at this region is exposed to the outside. Also, since a portion of the sheet 7 is separated along the longitudinal direction 16 at a region located near the one end 93 of the second medium 9 in the widthwise direction 17 and extending from the second endpoint E2 to the second end portion F2 in the longitudinal direction 16, the adhesive layer at this region is exposed to the outside. The user rotates the tape 87 180 degrees and engages the first cutting portion 48 of the first medium 8 and the second cutting portion 49 of the second medium 9 with each other. As illustrated in FIG. 6B, the user brings the first endpoint E1 of the first cutting portion 48 and the second endpoint E2 of the second cutting portion 49 into contact with each other. The user rotates the first medium 8 and the second medium 9, relative to each other, about their respective engaged portions. The user sticks the portion of the first medium 8 at which the adhesive layer is exposed to the outside, to a portion of the second medium 9 at a sticking portion R2 located near the one end 93 of the second medium 9 and nearer to the one end 91 of the second medium 9 than the second endpoint E2 in the longitudinal direction 16. Also, the user sticks the portion of the second medium 9 at which the adhesive layer is exposed to the outside, to a portion of the first medium 8 at a sticking portion R1 located near the one end 83 of the first medium 8 and nearer to one end 81 of the first medium 8 than the first endpoint E1 in the longitudinal direction 16. As illustrated in FIG. 6C, these operations enable the user to handle the first medium 8 and the second medium 9 as a one-piece medium 99. In the case where the user sticks the medium 99 to an object such as a wall, the user peels off the partial sheets 77, 78 from the medium 99 and sticks the medium 99 to a desired position.

In the above-described embodiment, the tape 60, the spool 72, the tape roll 600, the ink ribbon 613, the ribbon roll 20, the tape cassette 6, the housing 670, the opening 79, and the output portion 64 are respectively examples of a tape, a spool, a tape roll, a ribbon roll, a tape cassette, a housing, an opening, and an output portion. The sheet 7, the first medium 8, the second medium 9, the first separating line 44, the first cutting portion 48, the second cutting portion 49, the second separating line 43, and the third separating line 45 are respectively examples of a sheet, a first medium, a second medium, a first separating line, a first cutting portion, a second cutting portion, a second separating line, and a third separating line. The first dividing portion 55 and the second dividing portion 56 are respectively examples of a first dividing portion and a second dividing portion. The one end 71 and the other end 73 of the sheet 7 in the widthwise direction 17 are respectively examples of a first end and a second end of the sheet in the widthwise direction. The one end 81 and the other end 82 of the first medium 8 in the longitudinal direction 16 and the one end 83 and the other end 84 of the first medium 8 in the widthwise direction 17 are respectively examples of a first end and a second end of the first medium in the longitudinal direction and a first end and a second end of the first medium in the widthwise direction. The one end 91 and the other end 92 of the second medium 9 in the longitudinal direction 16 and the one end 93 and the other end 94 of the second medium 9 in the widthwise direction 17 are respectively examples of a first end and a second end of the second medium in the longitudinal direction and a first end and a second end of the second medium in the widthwise direction.

The tape cassette 6 according to the above-described embodiment includes the tape roll 600. In the tape 60 of the tape roll 600, in the case where the original image having a length greater than that of the media 8, 9 in the widthwise direction 17 is printed in the state in which the original image is divided into images each less than or equal to a corresponding one of the media 8, 9 in length in the widthwise direction 17, the user can engage the first cutting portion 48 of the first medium 8 and the second cutting portion 49 of the second medium 9 with each other to accurately position the first medium 8 and the second medium 9 in the longitudinal direction 16 in sticking.

In the tape 60, the first endpoint E1 and the second endpoint E2 are located at the same position in the widthwise direction 17. Accordingly, when the first medium 8 and the second medium 9 are stuck to each other by engaging the first cutting portion 48 of the first medium 8 and the second cutting portion 49 of the second medium 9 with each other, an amount of sticking in the widthwise direction 17 is the same between opposite-side portions of the first cutting portion 48 and the second cutting portion 49 in the longitudinal direction 16. The length from the first endpoint E1 to the one end 83 of the first medium 8 in the widthwise direction 17 is equal to the length from the second endpoint E2 to the one end 93 of the second medium 9 in the widthwise direction 17.

The first cutting portion 48 is located at the center M3 of the first medium 8 in the longitudinal direction 16. The second cutting portion 49 is located at the center M4 of the second medium 9 in the longitudinal direction 16. Accordingly, when compared with a case where each of cutting portions is provided at a one-side portion of the sheet 7 in the longitudinal direction 16, the tape 60 requires a short length of a sticking region for sticking the first medium 8 and the second medium 9 by engaging the first cutting portion 48 of the first medium 8 and the second cutting portion 49 of the second medium 9 with each other. This sticking length is a longer one of the length from the first endpoint E1 to the first end portion F1 and the length from the second endpoint E2 to the second end portion F2. This configuration enables the user to accurately stick the first medium 8 and the second medium 9 to each other.

The second separating line 43 extends in the sheet 7 at the first medium 8 from the first endpoint E1 in the longitudinal direction 16 except a portion of the sheet 7 which is located on an opposite side of the first endpoint E1 from the first end portion F1 in the longitudinal direction 16. The third separating line 45 extends in the sheet 7 at the second medium 9 from the second endpoint E2 in the longitudinal direction 16 except a portion of the sheet 7 which is located on an opposite side of the second endpoint E2 from the second end portion F2. When the user sticks the first medium 8 and the second medium 9 by engaging the first cutting portion 48 of the first medium 8 and the second cutting portion 49 of the second medium 9 with each other, the user can easily peel off only portions of the sheet 7 which respectively correspond to the portions of the first medium 8 and the second medium 9 which need to be exposed. Accordingly, the user can stick the first medium 8 and the second medium 9 to each other in a state in which a portion of the sheet 7 which is to be covered with one of the first medium 8 and the second medium 9 is kept stuck to the other.

Each of the second separating line 43 and the third separating line 45 is located at a distance of greater than or equal to 3 mm in the widthwise direction 17 from the one end 71 of the sheet 7 in the widthwise direction 17. This configuration makes it easier for the user to peel off the sheet 7 from the sticking portion at which the first medium 8 and the second medium 9 are to be stuck to each other when compared with a case where the second separating line 43 is located at a distance of less than 3 mm from the one end 71 of the sheet 7. In the configuration in which the distance from the one end 71 of the sheet 7 to the second separating line 43 and the third separating line 45 is greater than or equal to 3 mm, the width of the sheet 7 is enough for the user to peel off the sheet 7 even in the case where the sheet 7 is a paper sheet. Thus, when the user peels off the sheet 7 along the second separating line 43 and the third separating line 45 near the one end 71 of the sheet 7, it is difficult for the sheet 7 to be torn off.

The second medium 9 extends in the longitudinal direction 16 and has the image 42 at a region located farther from the second cutting portion 49 than the center M2 of the second medium 9 in the widthwise direction 17. With this configuration, in the case where the first medium 8 and the second medium 9 are stuck to each other, and the medium 99 is stuck to the object in the state in which the second medium 9 is located on the upper surface of the first medium 8, the image 42 can be disposed on the top of the medium 99.

In each pair, the first medium 8 and the second medium 9 are peelably stuck to the sheet 7 so as to be spaced apart from each other in the longitudinal direction 16. This configuration facilitates separating the sheet 7 of the tape 60 along the first separating line 44 when compared with a case where the first medium 8 and the second medium 9 are not spaced apart from each other in the longitudinal direction 16 of the sheet 7.

The sum of the length of the first cutting portion 48 in the widthwise direction 17 and the length of the second cutting portion 49 in the widthwise direction 17 is equal to the distance from the one end 83 of the first medium 8 in the widthwise direction 17 to the second separating line 43. The distance from the one end 83 of the first medium 8 in the widthwise direction 17 to the second separating line 43 is equal to the distance from the one end 93 of the second medium 9 in the widthwise direction 17 to the third separating line 45. In the case where the first cutting portion 48 of the first medium 8 and the second cutting portion 49 of the second medium 9 are engaged with each other, the one end 83 of the first medium 8 in the widthwise direction 17 and the third separating line 45 formed in the second medium 9 are located at the same position in the widthwise direction 17, and the one end 93 of the second medium 9 in the widthwise direction 17 and the second separating line 43 formed in the first medium 8 are located at the same position in the widthwise direction 17. Thus, an amount of sticking between the first medium 8 and the second medium 9 in the widthwise direction 17 is the same between a portion of the first medium 8 which extends from the first endpoint E1 to the one end 81 and a portion of the first medium 8 which extends from the first endpoint E1 to the other end 82 in the longitudinal direction 16.

The length of the first cutting portion 48 in the widthwise direction 17 is equal to the length of the second cutting portion 49 in the widthwise direction 17. Thus, an amount of sticking between the first medium 8 and the second medium 9 in the longitudinal direction 16 is also the same between the portion of the first medium 8 which extends from the first endpoint E1 to the one end 81 and the portion of the first medium 8 which extends from the first endpoint E1 to the other end 82 in the longitudinal direction 16. That is, the areas of the sticking portions R1, R2 in FIG. 6B are the same as each other.

The tape 60 has the first dividing portion 55 and the second dividing portion 56. The first dividing portion 55 has the through portion (e.g., through holes or the like) formed through the sheet 7 in the thickness direction of the sheet 7. The position of the first dividing portion 55 in the longitudinal direction 16 and the position of the first endpoint E1 in the longitudinal direction 16 are the same as each other. The first dividing portion 55 extends in the widthwise direction 17 from the second separating line 43 to the one end 71 of the sheet 7 in the widthwise direction 17. The second dividing portion 56 has the through portion (e.g., through holes or the like) formed through the sheet 7 in the thickness direction of the sheet 7. The position of the second dividing portion 56 in the longitudinal direction 16 and the position of the second endpoint E2 in the longitudinal direction 16 are the same as each other. The second dividing portion 56 extends in the widthwise direction 17 from the third separating line 45 to the one end 71 of the sheet 7 in the widthwise direction 17. This configuration facilitates separating the sheet 7 at positions corresponding to the first cutting portion 48 and the second cutting portion 49 when compared with a case where the first dividing portion 55 and the second dividing portion 56 are not provided.

The tape cassette 6 includes the tape roll 600, the ribbon roll 20, the housing 670, the opening 79, and the output portion 64. The ribbon roll 20 is the roll of the ink ribbon 613 to be used for printing on the tape 60. The housing 670 contains the tape roll 600 and the ribbon roll 20. The opening 79 exposes the ink ribbon 613 and the tape 60 to the outside of the housing 670. The tape 60 exposed from the opening 79 to the outside of the housing 670 is passed through the output portion 64. The length L between the opening 79 and the output portion 64 is less than the distance D1 between two of the plurality of pairs of the first media 8 and the second media 9, which two are adjacent to each other in the longitudinal direction 16 of the sheet 7. The tape cassette 6 is installed on the printing apparatus 1 including the cutters (the movable blade 141 and the fixed blade 142) provided adjacent to the output portion 64. An end portion of the second medium 9 of the next pair of the second medium 9 and the first medium 8 is located in the housing 670 at the point in time when the tape 60 is cut after printing. That is, the end portion of the second medium 9 is located upstream, in the conveying direction, of a printing position opposed to the thermal head 29. The upstream side in the conveying direction is the same as a spool-side in the longitudinal direction 16.

The tape cassette 6 includes the tape roll 600, the ribbon roll 20, and the housing 670. The tape roll 600 is the roll of the tape 60 wound around the spool 72. The ribbon roll 20 is the roll of the ink ribbon 613 to be used for printing on the tape 60. The housing 670 contains the tape roll 600 and the ribbon roll 20. The second medium 9 of the tape 60 includes the image 42 formed in a first color. The ink ribbon 613 has ink of a second color different from the first color. Accordingly, an image formed in the first and second colors can be formed on the medium 99 including the first medium 8 and the second medium 9 stuck to each other.

Modifications

While the embodiment has been described above, it is to be understood that the disclosure is not limited to the details of the illustrated embodiment, but may be embodied with various changes and modifications, which may occur to those skilled in the art, without departing from the spirit and scope of the disclosure. For example, the following modifications may be made. It is noted that the same reference numerals as used in the above-described embodiment are used to designate the corresponding elements of the modifications.

The shape, size, color, arrangement on the sheet, and so on of the first medium and the second medium may be changed as needed. In one example, the shapes of the first medium and the second medium may not be the same as each other. For example, each of the first medium and the second medium may have a semicircular shape such that the first medium and the second medium stuck to each other constitute a circular medium. In another example, the second medium may not have an image extending in the longitudinal direction of the tape. In still another example, the positions of the first cutting portion and the second cutting portion in the longitudinal direction of the sheet may be changed as long as the sum of (i) the distance in the longitudinal direction between the first endpoint of the first cutting portion and one of the opposite ends of the first medium which is nearer to the first separating line than the other in the longitudinal direction and (ii) the distance in the longitudinal direction between the second endpoint of the second cutting portion and one of the opposite ends of the second medium which is nearer to the first separating line than the other in the longitudinal direction is equal to the length of each of the first medium and the second medium in the longitudinal direction.

Figure 7A:
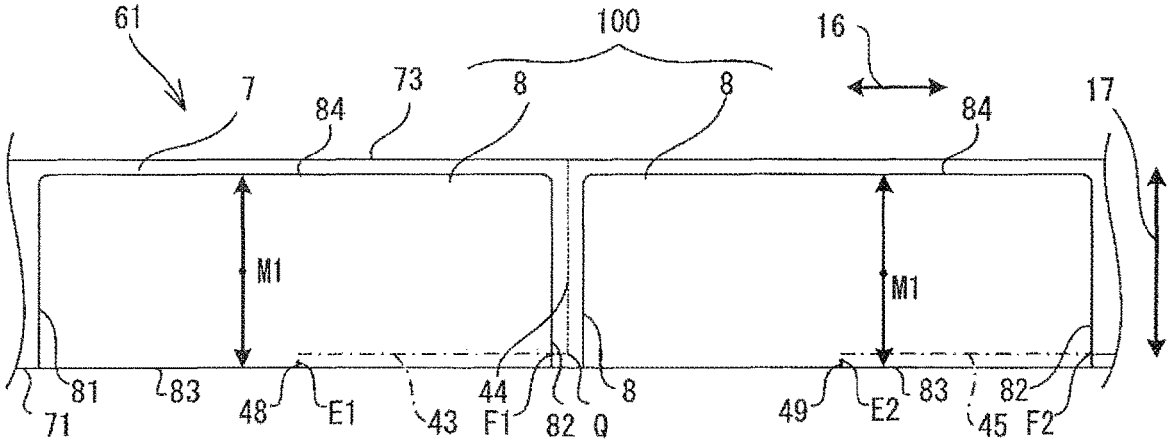
FIGS. 7A and 7B are views of tapes in modifications.
Figure 7B:
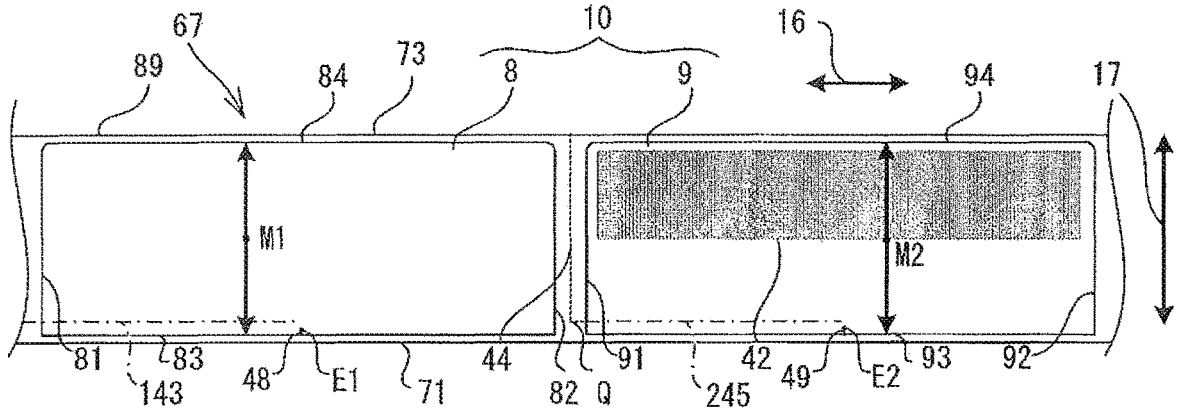

In a modification, as illustrated in FIG. 7A, a tape 61 may include a plurality of pairs 100 of the first media 8. In each pair 100, the two first media 8 have the same shape and each does not have an image. In each pair 100, the first separating line 44 is located between the two first media 8 and extends in the widthwise direction 17 in the sheet 7. In another modification, as illustrated in FIG. 7B, a tape 67 is configured such that the position of each of the one end 83 of the first medium 8 and the one end 93 of the second medium 9, and the position of one end 71 of a sheet 89 are not the same as each other in the widthwise direction 17. The distance between the center M1 of the first medium 8 in the widthwise direction 17 and the one end 71 of the sheet 89 in the widthwise direction 17 is greater than the distance between the center M1 of the first medium 8 in the widthwise direction 17 and the one end 83 of the first medium 8 in the widthwise direction 17. With this configuration, in the case where borderless printing is performed on the medium, the printing position in the widthwise direction 17 in some cases deviates from an appropriate position, and an image is partly printed on the outside of the one ends 83, 93 of the respective media 8, 9 in the widthwise direction 17. In the present modification, even in these cases, the protruding portion of the image is printed on the sheet 100 if possible, causing no damage to the printing apparatus 1. Also, a direction in which a second separating line 143 extends from the first endpoint E1 and a direction in which a third separating line 245 extends from the second endpoint E2 in the tape 67 are respectively opposite to the direction in which the second separating line 43 extends from the first endpoint E1 and the direction in which the third separating line 45 extends from the second endpoint E2 in the tape 60 in FIGS. 5A-5D. The third separating line 245 extends to the first separating line 44.

Figure 8A:
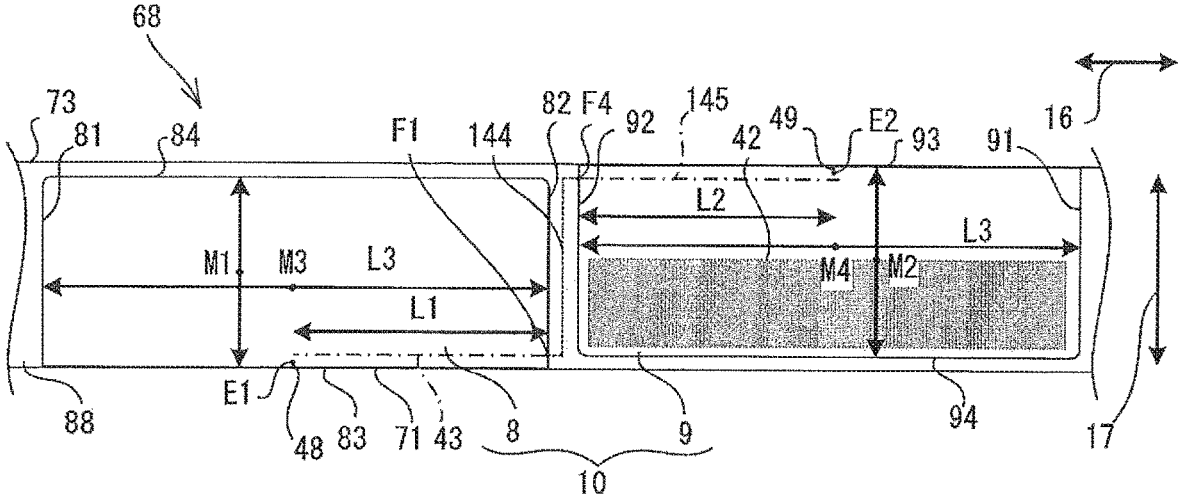
FIG. 8A is a view of a tape in another modification.
Figure 8B:
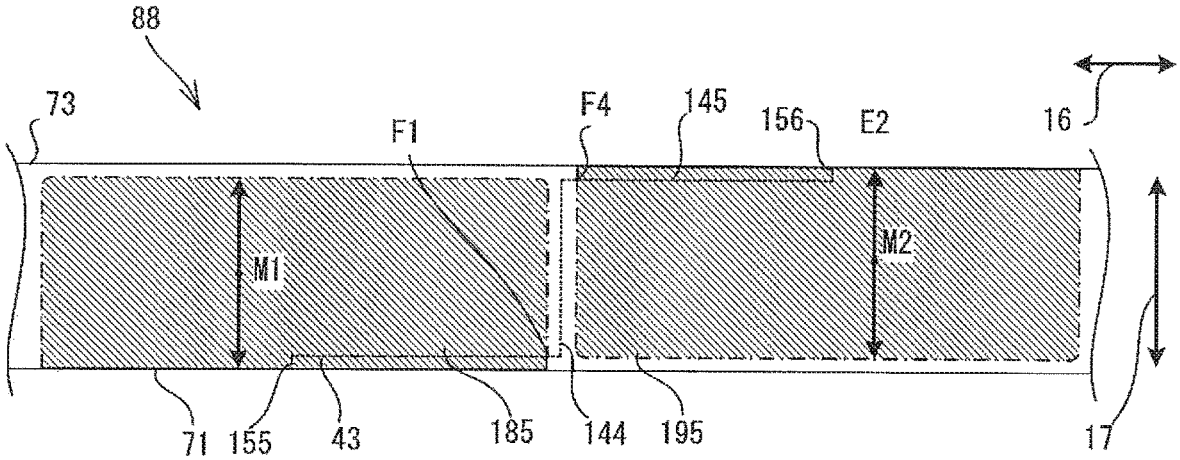
FIG. 8B is a view of a sheet of the tape in FIG. 8A, illustrating a first portion to which the first medium is stuck and a second portion to which the second medium is stuck.

In still another modification, as illustrated in FIGS. 8A and 8B, a tape 68 includes a strip-shaped sheet 88, a plurality of pairs of the first media 8 and the second media 9, a first separating line 144, the first cutting portion 48, the second cutting portion 49, the second separating line 43, and a third separating line 145. The tape 68 further includes a first dividing portion 155 and a second dividing portion 156. The orientation of the second medium 9 of the tape 68 is opposite to that of the second medium 9 of the tape 60 according to the above-described embodiment. The position of the one end 93 of the second medium 9 in the widthwise direction 17 and the position of the other end 73 of the sheet 88 in the widthwise direction 17 are the same as each other. In the tape 68, the orientation of an image to be printed on the first medium 8 and the orientation of an image to be printed on the second medium 9 are the same as each other. In each pair, the first separating line 144 is located between the first medium 8 and the second medium 9 in the longitudinal direction 16 and extends in the sheet 88 from the one end 71 to the other end 73 in the widthwise direction 17 orthogonal to the longitudinal direction 16. The first separating line 144 includes a portion of the sheet which is cut in the thickness direction or through which holes or the like is formed in the thickness direction. In the present example, the first separating line 144 does not extend to the one end 71 and the other end 73 in the widthwise direction 17.

The first cutting portion 48 extends from the one end 83 of the first medium 8 in the widthwise direction 17 to the first endpoint E1. The one end 83 of the first medium 8 in the widthwise direction 17 is nearer to the one end 71 of the sheet 88 in the widthwise direction 17 than the center M1 of the first medium 8 in the widthwise direction 17. The first endpoint E1 is located between the one end 83 of the first medium 8 in the widthwise direction 17 and the center M1 of the first medium 8 in the widthwise direction 17. The first cutting portion 48 is formed through the first medium 8. The second cutting portion 49 extends from the one end 93 of the second medium 9 in the widthwise direction 17 to the second endpoint E2. The one end 93 of the second medium 9 in the widthwise direction 17 is nearer to the other end 73 of the sheet 88 in the widthwise direction 17 than the center M2 of the second medium 9 in the widthwise direction 17. The second endpoint E2 is located between the one end 93 of the second medium 9 in the widthwise direction 17 and the center M2 of the second medium 9 in the widthwise direction 17. The second cutting portion 49 is formed through the second medium 9. The position of the second endpoint E2 in the longitudinal direction 16 is determined such that the sum of the distance L1 and the distance L2 is equal to the length L3 of the second medium 9 in the longitudinal direction 16. The distance L2 is a distance in the longitudinal direction 16 between the second endpoint E2 and the other end 92 of the second medium 9 in the longitudinal direction 16. The other end 92 is nearer to the first separating line 144 than the center M4 of the second medium 9 in the longitudinal direction 16. The distance L1 is a distance in the longitudinal direction 16 between the first endpoint E1 and the other end 82 of the first medium 8 in the longitudinal direction 16. The other end 82 is nearer to the first separating line 144 than the center M3 of the first medium 8 in the longitudinal direction 16.

The second separating line 43 is provided in a first portion 185 of the sheet 88 to which the first medium 8 is stuck. The second separating line 43 is located in the widthwise direction 17 between the center M1 of the first medium 8 in the widthwise direction 17 and the one end 83 of the first medium 8 in the widthwise direction 17. The second separating line 43 extends in the longitudinal direction 16 from the first endpoint E1 to the first end portion F1 that is one of the one end 81 and the other end 82 of the first medium 8 in the longitudinal direction 16. In the present modification, the first end portion F1 is one example of a first-medium end portion. In the present modification, the second separating line 43 extends to the first separating line 144 in the longitudinal direction 16. The second separating line 43 is located between the first endpoint E1 and the center M1 in the widthwise direction 17. The third separating line 145 is provided in a second portion 195 of the sheet 88 to which the second medium 9 is stuck. The third separating line 145 is located in the widthwise direction 17 between the center M2 of the second medium 9 in the widthwise direction 17 and the other end 94 of the second medium 9 in the widthwise direction 17. The third separating line 145 extends in the longitudinal direction 16 from the second endpoint E2 to a second end portion F4. The second end portion F4 is one of the one end 91 and the other end 92 of the second medium 9 in the longitudinal direction 16. In the present modification, the second end portion F4 is one example of a second-medium end portion. A direction directed from the first endpoint E1 toward the first end portion F1 in the longitudinal direction 16 (i.e., a right direction in FIG. 8A) and a direction directed from the second endpoint E2 toward the second end portion F4 (i.e., a left direction in FIG. 8A) in the longitudinal direction 16 are opposite to each other. In other words, a side of the first endpoint E1 on which the first end portion F1 is located in the longitudinal direction 16 (i.e., a right side in FIG. 8A) and a side of the second endpoint E2 on which the second end portion F4 is located in the longitudinal direction 16 (i.e., a left side in FIG. 8A) are opposite to each other. That is, a relationship between the side of the first endpoint E1 on which the first end portion F1 is located in the longitudinal direction 16 (the direction directed from the first endpoint E1 toward the first end portion F1 in the longitudinal direction 16) and the side of the second endpoint E2 on which the second end portion F4 is located in the longitudinal direction 16 (the direction directed from the second endpoint E2 toward the second end portion F4 in the longitudinal direction 16) is a reverse relationship. The third separating line 145 is located between the second endpoint E2 and the center M2 in the widthwise direction 17. In the present modification, the third separating line 145 extends to the first separating line 144 in the longitudinal direction 16. Each of the second separating line 143 and the third separating line 145 includes a portion of the sheet 88 which is cut in the thickness direction or through which holes or the like is formed in the thickness direction.

Figure 8C:
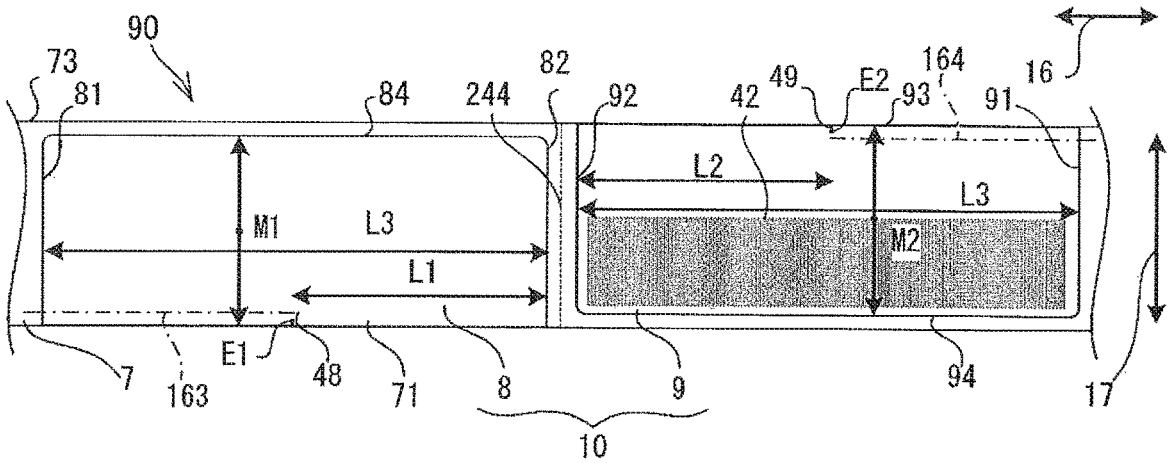
FIG. 8C is a view of a tape in still another modification.
Figure 9A:
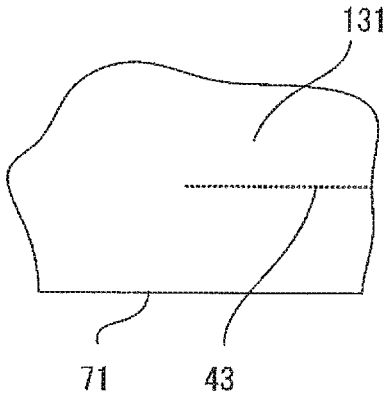
FIGS. 9A through 9D are views of sheets in still other modifications.
Figure 9B:
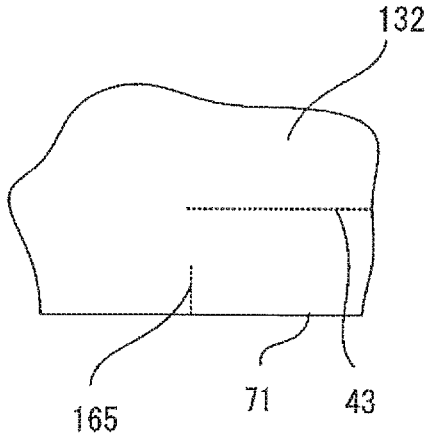
Figure 9C:
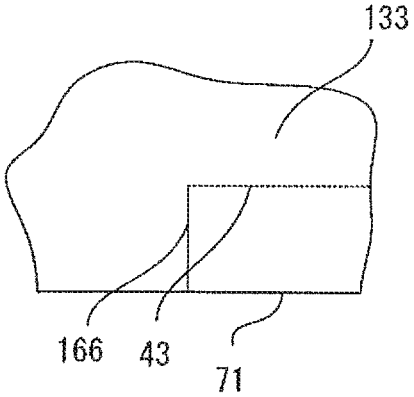
Figure 9D:
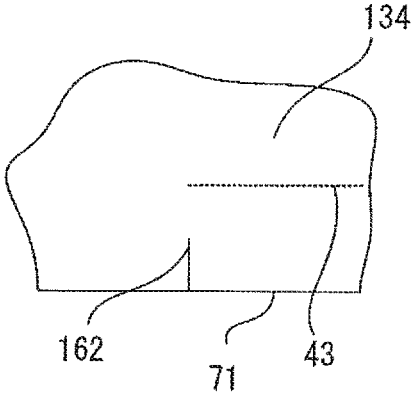

In still another modification, as illustrated in FIG. 8C, a tape 90 may include a first separating line 244, a second separating line 163, and a third separating line 164. The first separating line 244 extends from the one end 71 to the other end 73 of the sheet 88 in the widthwise direction 17. The second separating line 163 extends in the longitudinal direction 16 from the first endpoint E1 in a direction away from the first separating line 244 of the tape 90. The third separating line 164 extends in the longitudinal direction 16 from the second endpoint E2 in a direction away from the first separating line 244 of the tape 90. Also in this modification, the sum of (i) the distance L1 in the longitudinal direction 16 between the first endpoint E1 and the other end 82 of the first medium 8 near the first separating line 244 and (ii) the distance L2 between the second endpoint E2 and the other end 92 of the second medium 9 near the first separating line 244 is equal to the length L3 of each of the first medium 8 and the second medium 9 in the longitudinal direction 16. The positions of the one end and the other end of the second medium 9 with respect to the sheet 7 in the widthwise direction 17 in the tapes 68, 90 are reverse to the positions of the one end and the other end of the second medium 9 with respect to the sheet 7 in the widthwise direction 17 in the tape 60. The number of portions of the sheet to be peeled off in sticking of the first medium 8 and the second medium 9 is smaller in the tape 68 illustrated in FIG. 8A than in the tape 90 illustrated in FIG. 8C. A region at which the first separating line 244 is provided may be changed as needed in the tapes 68, 90. It is noted that in the modification illustrated in FIG. 8C, the first end portion F1 is the one end 81 located on a left side (a side toward which the second separating line 163 extends from the first endpoint E1) of the first endpoint E1, i.e., the one end 81 located on a downstream side of the first endpoint E1 in a direction (the left direction) in which the second separating line 163 extends from the first endpoint E1, among the one end 81 and the other end 82 of the first medium 8 in the longitudinal direction 16. Also, the second end portion F4 is the one end 91 located on a right side (a side toward which the third separating line 164 extends from the second endpoint E2) of the second endpoint E2, i.e., the one end 91 located on a downstream side of the second endpoint E2 in a direction (the right direction) in which the third separating line 164 extends from the second endpoint E2, among the one end 91 and the other end 92 of the second medium 9 in the longitudinal direction 16. That is, also in the modification illustrated in FIG. 8C, a relationship between the side of the first endpoint E1 on which the first end portion F1 is located in the longitudinal direction 16 (the direction directed from the first endpoint E1 toward the first end portion F1 in the longitudinal direction 16) and the side of the second endpoint E2 on which the second end portion F4 is located in the longitudinal direction 16 (the direction directed from the second endpoint E2 toward the second end portion F4 in the longitudinal direction 16) is a reverse relationship.

The configuration of the sheet may be changed as needed. The shapes of the first dividing portion and the second dividing portion, regions at which the first dividing portion and the second dividing portion are provided, and so on may be changed as needed. At least one of the first dividing portion and the second dividing portion may be omitted as needed. In the case where the sheet does not include the first dividing portion and the second dividing portion, the user may cut the sheet at positions corresponding to the first cutting portion and the second cutting portion by breaking the sheet by hands or cutting the sheet with scissors. The shapes of the first dividing portion and the first cutting portion may or may not be the same as each other. Likewise, the shapes of the second dividing portion and the second cutting portion may or may not be the same as each other.

There will be explained modifications in the case where the first dividing portion and the second dividing portion are provided, with reference to FIGS. 9A-9D, taking the first dividing portion as one example, but these modifications may apply to the second dividing portion. The right and left direction and the up and down direction in FIGS. 9A-9D respectively correspond to the longitudinal direction and the widthwise direction of the sheet in the modifications. A sheet 131 illustrated in FIG. 9A does not include the first dividing portion. A sheet 132 illustrated in FIG. 9B includes a first dividing portion 165. The first dividing portion 165 extends in the widthwise direction from the one end 71 of the sheet 132 in the widthwise direction, to a position corresponding to the first endpoint E1 on the first medium 8. The first dividing portion 165 has a line shape. The first dividing portion 165 is perforation like the second separating line 43, for example. The user may cut a portion of the sheet 132 between the first dividing portion 165 and the second separating line 43 by breaking the portion by hands or cutting the portion with scissors. A sheet 133 illustrated in FIG. 9C includes a first dividing portion 166. The first dividing portion 166 extends in the widthwise direction from the one end 71 of the sheet 133 in the widthwise direction to the second separating line 43 so as to have a line shape. The first dividing portion 166 is a cut, for example. A sheet 134 illustrated in FIG. 9D includes a first dividing portion 162. The first dividing portion 162 extends in the widthwise direction from the one end 71 of the sheet 134 in the widthwise direction to a position corresponding to the first endpoint E1 on the first medium 8. The first dividing portion 162 has a line shape. The first dividing portion 162 is a cut, for example.

Figure 10A:
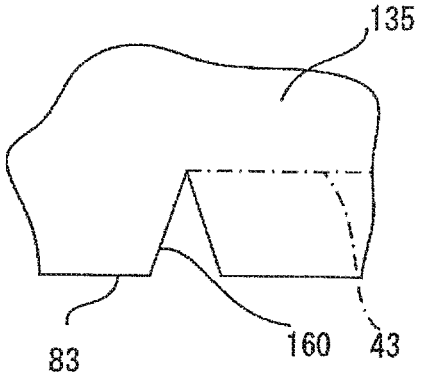
FIGS. 10 A through 10D are views of first media in still other modifications.
Figure 10B:
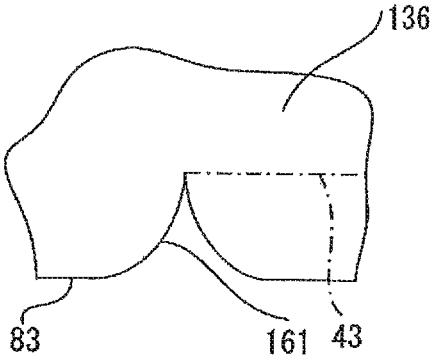
Figure 10C:
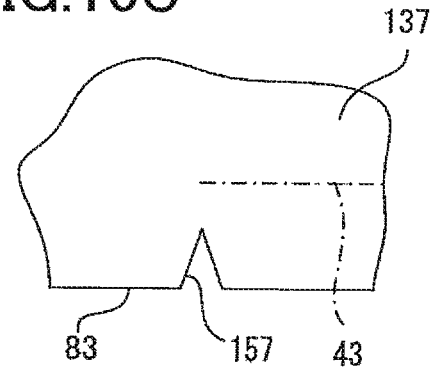
Figure 10D:
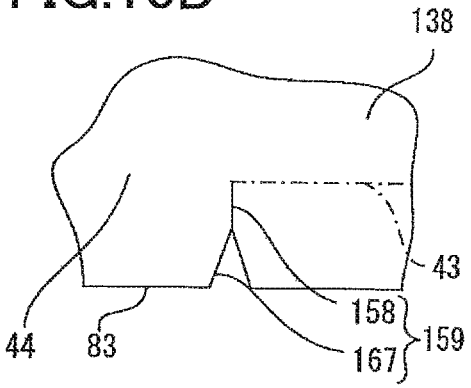

The shapes of the first cutting portion and the second cutting portion may be changed as needed. There will be explained modifications of the shapes of the first cutting portion and the second cutting portion with reference to FIGS. 10A-10D, taking the first cutting portion as one example, but these modifications may apply to the second cutting portion. A first medium 135 illustrated in FIG. 10A includes a first cutting portion 160. The first cutting portion 160 is a cutout having an inverted V-shape and extending in the widthwise direction from the one end 83 of the first medium 135 in the widthwise direction to the second separating line 43. A first medium 136 illustrated in FIG. 10B includes a first cutting portion 161. The first cutting portion 161 is a cutout having an inverted V-shape and extending in the widthwise direction from the one end 83 of the first medium 136 in the widthwise direction to the second separating line 43. Each of portions of the first cutting portion 160 which form the inverted V-shape is a straight line, while the shape of each of portions of the first cutting portion 161 which form the inverted V-shape is an arc that curves about a point on the first medium. A first medium 137 illustrated in FIG. 10C includes a first cutting portion 157. The first cutting portion 157 is a cutout having an inverted V-shape and extending in the widthwise direction from the one end 83 of the first medium 137 in the widthwise direction to a position corresponding to the first endpoint E1 on the first medium 8. A first medium 138 illustrated in FIG. 10D includes a first cutting portion 159. The first cutting portion 159 includes: a cutout 167 similar to the first cutting portion 157; and a cutting line 158 formed through the first medium 138 in the thickness direction and extending in the widthwise direction from the top of the cutout 167, which is an upper end of the cutout 167 in FIG. 10, to the second separating line 43 so as to have a line shape. Each of portions of the cutout 167 which form the inverted V-shape may have an arc-shape like the first cutting portion 161. In each pair, the first cutting portion of the first medium and the second cutting portion of the second medium may or may not have the same shape as each other. The shape of each of the first dividing portion and the second dividing portion may be changed as needed as in the above-described modifications of the cutting portions. For example, each of the first dividing portion and the second dividing portion may be a cutout having an inverted V-shape.

Regions at which the second separating line and the third separating line are provided in the longitudinal direction of the sheet may be changed as needed. For example, the second separating line may extend in the longitudinal direction of the sheet from the one end to the other end of the first medium in the longitudinal direction. The second separating line and the third separating line may be continuous to each other in the longitudinal direction of the sheet. At least one of the second separating line and the third separating line need not be connected to the first separating line. A portion of the sheet between one of the pairs and another of the pairs in the longitudinal direction may include a portion which is cut in the thickness direction or through which holes or the like is formed in the thickness direction. Each of the first separating line, the second separating line, and the third separate line at least needs to have a portion of the sheet which is cut in the thickness direction or through which holes or the like is formed in the thickness direction. Each of the first separating line and the second separating line may have a portion of the sheet which is cut in the thickness direction of the sheet without extending through the sheet in its thickness direction. The portion cut in the thickness direction of the sheet may be a recess having a V-shape or a U-shape in cross section in the thickness direction or a line extending in the thickness direction, for example. The portion cut in the thickness direction of the sheet may be provided on a front surface or a back surface of the sheet.

Another medium may be disposed between adjacent two of a plurality of pairs of the first media and the second media. For example, in still another modification, a tape may include at least one third medium such as a round medium, a triangle medium, and a rhombus medium. The third medium is disposed between the two pairs of the first media and the second media adjacent to each other in the longitudinal direction of the sheet. The color of the third medium may be different from that of the ink ribbon contained in the tape cassette. In the tape according to this modification, the first medium, the second medium, and the third medium may be combined with one another to create a printing medium satisfying standards (e.g., ANSIZ535 and IEC60417) of a printing medium representing warning.

The tape may not be wound around the spool. The tape roll may not be installed on the cassette. The configurations of the tape cassette and the printing apparatus on which the tape cassette is installed may be changed as needed. No printing may be performed on the first medium and the second medium of the tape. The color, the material, and so on of the first medium, the second medium, and the ink of the ink ribbon may be changed as needed. The above-described embodiment and the modifications may be combined as needed. One end and the other end of the sheet in the longitudinal direction and one end and the other end of the sheet in the widthwise direction may be changed as needed. The method of manufacturing the tape may be changed as needed. A portion of the medium having the same shape as that of the sheet, which portion is different from the first media and the second media, may be partly or entirely kept stuck to the sheet. In this case, a step of peeling off the portion of the medium which is different from the first media 8 and the second media 9 may be omitted as needed.

What is claimed is:

1. A tape, comprising:

a sheet having a strip shape;

a plurality of pairs of first media and second media, each of the plurality of pairs comprising a first medium and a second medium arranged adjacent to each other in a longitudinal direction of the sheet, the first medium and the second medium being spaced apart from each other in the longitudinal direction, the first medium and the second medium being peelably stuck to the sheet;

a first separating line formed at a portion of the sheet which is located between the first medium and the second medium of one pair of the plurality of pairs of the first media and the second media, the first separating line extending, in a widthwise direction orthogonal to the longitudinal direction, over at least a portion of a region extending in the widthwise direction from a first end of the sheet in the widthwise direction to a second end of the sheet in the widthwise direction, the first separating line comprising a portion formed through or cut in the sheet in a thickness direction of the sheet, the first medium comprising a first end and a second end in the widthwise direction, the first end of the first medium in the widthwise direction being nearer in the widthwise direction to the first end of the sheet in the widthwise direction than the second end of the first medium in the widthwise direction, the second medium comprising a first end and a second end in the widthwise direction, the first end of the second medium in the widthwise direction being nearer in the widthwise direction to the first end of the sheet in the widthwise direction than the second end of the second medium in the widthwise direction;

a first cutting portion formed through the first medium and extending from the first end of the first medium in the widthwise direction to a first endpoint located between the first end of the first medium in the widthwise direction and a center position of the first medium in the widthwise direction;

a second cutting portion formed through the second medium and extending from the first end of the second medium in the widthwise direction to a second endpoint located between the first end of the second medium in the widthwise direction and a center position of the second medium in the widthwise direction, the second endpoint and the first cutting portion being equidistant in the longitudinal direction from a center position of the portion of the sheet in the longitudinal direction, which portion is located between the first medium and the second medium of the one pair;

a second separating line provided at a first portion of the sheet to which the first medium is stuck, the second separating line being located in the widthwise direction between the center position of the first medium in the widthwise direction and the first end of the first medium in the widthwise direction, the second separating line being at least extending in the longitudinal direction between the first endpoint and a first-medium end portion that is one of a first end and a second end of the first medium in the longitudinal direction, the second separating line comprising a portion formed through or cut in the sheet in the thickness direction; and a third separating line provided at a second portion of the sheet to which the second medium is stuck, the third separating line being located in the widthwise direction between the center position of the second medium in the widthwise direction and the first end of the second medium in the widthwise direction, the third separating line at least extending in the longitudinal direction between the second endpoint and a second-medium end portion that is one of a first end and a second end of the second medium in the longitudinal direction, wherein a side, with respect to the first endpoint, on which the first-medium end portion is located in the longitudinal direction is identical to a side, with respect to the second endpoint, on which the second-medium end portion is located in the longitudinal direction, the third separating line comprising a portion formed through or cut in the sheet in the thickness direction.

2. The tape according to claim 1, wherein each of the second separating line and the third separating line extends in a direction parallel with the longitudinal direction of the sheet.

3. The tape according to claim 1, wherein the first cutting portion is located at a center position of the first medium in the longitudinal direction, and wherein the second cutting portion is located at a center position of the second medium in the longitudinal direction.

4. The tape according to claim 1, wherein the second separating line extends from the first endpoint in the longitudinal direction so as to avoid an opposite side of the first endpoint from the first-medium end portion, and wherein the third separating line extends from the second endpoint in the longitudinal direction so as to avoid an opposite side of the second endpoint from the second-medium end portion.

5. The tape according to claim 1, wherein the second medium comprises an image extending in the longitudinal direction and nearer to the second end of the second medium in the widthwise direction than the center position of the second medium in the widthwise direction.

6. The tape according to claim 1, wherein the first medium and the second medium of the one pair are peelably stuck to the tape so as to be spaced apart from each other in the longitudinal direction.

7. The tape according to claim 1, wherein a sum of a length of the first cutting portion in the widthwise direction and a length of the second cutting portion in the widthwise direction is equal to a length from the first end of the first medium in the widthwise direction to the second separating line.

8. The tape according to claim 7, wherein the length of the first cutting portion in the widthwise direction is equal to the length of the second cutting portion in the widthwise direction.

9. The tape according to claim 1, further comprising:

a first dividing portion comprising a portion formed through the sheet in the thickness direction of the sheet, the first dividing portion being identical to the first endpoint in position in the longitudinal direction, the first dividing portion extending in the widthwise direction, from a position corresponding to the second separating line in the widthwise direction, to the first end of the sheet in the widthwise direction; and a second dividing portion comprising a portion formed through the sheet in the thickness direction of the sheet, the second dividing portion being identical to the second endpoint in position in the longitudinal direction, the second dividing portion extending in the widthwise direction, from a position corresponding to the third separating line in the widthwise direction, to the first end of the sheet in the widthwise direction.

10. A tape, comprising:

a sheet having a strip shape;

a plurality of pairs of first media and second media, each of the plurality of pairs comprising a first medium and a second medium arranged adjacent to each other in a longitudinal direction of the sheet, the first medium and the second medium being spaced apart from each other in the longitudinal direction, the first medium and the second medium being peelably stuck to the sheet;

a first separating line formed at a portion of the sheet which is located between the first medium and the second medium of one pair of the plurality of pairs of the first media and the second media, the first separating line extending, in a widthwise direction orthogonal to the longitudinal direction, over at least a portion of a region extending in the widthwise direction from a first end of the sheet in the widthwise direction to a second end of the sheet in the widthwise direction, the first separating line comprising a portion formed through or cut in the sheet in a thickness direction of the sheet, the first medium comprising a first end and a second end in the widthwise direction, the first end of the first medium in the widthwise direction being nearer in the widthwise direction to the first end of the sheet in the widthwise direction than the second end of the first medium in the widthwise direction, the second medium comprising a first end and a second end in the widthwise direction, the second end of the second medium in the widthwise direction being nearer in the widthwise direction to the second end of the sheet in the widthwise direction than the first end of the second medium in the widthwise direction;

a first cutting portion formed through the first medium and extending from the first end of the first medium in the widthwise direction to a first endpoint located between the first end of the first medium in the widthwise direction and a center position of the first medium in the widthwise direction;

a second cutting portion formed through the second medium and extending from the second end of the second medium in the widthwise direction to a second endpoint located between the second end of the second medium in the widthwise direction and a center position of the second medium in the widthwise direction, the second endpoint being located in the longitudinal direction such that a sum of (i) a distance between the first endpoint and one of a first end and a second end of the first medium in the longitudinal direction, which one is nearer to the first separating line than the other, and (ii) a distance between the second endpoint and one of a first end and a second end of the second medium in the longitudinal direction, which one is nearer to the first separating line than the other, is equal to a length of the second medium in the longitudinal direction;

a second separating line provided at a first portion of the sheet to which the first medium is stuck, the second separating line being located in the widthwise direction between the center position of the first medium in the widthwise direction and the first end of the first medium in the widthwise direction, the second separating line being at least extending in the longitudinal direction between the first endpoint and a first-medium end portion that is the one of the first end and the second end of the first medium in the longitudinal direction, the second separating line comprising a portion formed through or cut in the sheet in the thickness direction; and a third separating line provided at a second portion of the sheet to which the second medium is stuck, the third separating line being located in the widthwise direction between the center position of the second medium in the widthwise direction and the second end of the second medium in the widthwise direction, the third separating line at least extending in the longitudinal direction between the second endpoint and a second-medium end portion that is the one of the first end and the second end of the second medium in the longitudinal direction, wherein a side, with respect to the first endpoint, on which the first-medium end portion is located in the longitudinal direction is opposite to a side, with respect to the second endpoint, on which the second-medium end portion is located in the longitudinal direction, the third separating line comprising a portion formed through or cut in the sheet in the thickness direction.

11. A tape cassette, comprising:

a tape roll comprising (a) a spool and (b) a tape wound around the spool, the tape comprising (i) a sheet having a strip shape, (ii) a plurality of pairs of first media and second media, each of the plurality of pairs comprising a first medium and a second medium arranged adjacent to each other in a longitudinal direction of the sheet, the first medium and the second medium being spaced apart from each other in the longitudinal direction, the first medium and the second medium being peelably stuck to the sheet, (iii) a first separating line formed at a portion of the sheet which is located between the first medium and the second medium of one pair of the plurality of pairs of the first media and the second media, the first separating line extending, in a widthwise direction orthogonal to the longitudinal direction, over at least a portion of a region extending in the widthwise direction from a first end of the sheet in the widthwise direction to a second end of the sheet in the widthwise direction, the first separating line comprising a portion formed through or cut in the sheet in a thickness direction of the sheet, the first medium comprising a first end and a second end in the widthwise direction, the first end of the first medium in the widthwise direction being nearer in the widthwise direction to the first end of the sheet in the widthwise direction than the second end of the first medium in the widthwise direction, the second medium comprising a first end and a second end in the widthwise direction, the first end of the second medium in the widthwise direction being nearer in the widthwise direction to the first end of the sheet in the widthwise direction than the second end of the second medium in the widthwise direction, (iv) a first cutting portion formed through the first medium and extending from the first end of the first medium in the widthwise direction to a first endpoint located between the first end of the first medium in the widthwise direction and a center position of the first medium in the widthwise direction, (v) a second cutting portion formed through the second medium and extending from the first end of the second medium in the widthwise direction to a second endpoint located between the first end of the second medium in the widthwise direction and a center position of the second medium in the widthwise direction, the second endpoint and the first cutting portion being equidistant in the longitudinal direction from a center position of the portion of the sheet in the longitudinal direction, which portion is located between the first medium and the second medium of the one pair, (vi) a second separating line provided at a first portion of the sheet to which the first medium is stuck, the second separating line being located in the widthwise direction between the center position of the first medium in the widthwise direction and the first end of the first medium in the widthwise direction, the second separating line being at least extending in the longitudinal direction between the first endpoint and a first-medium end portion that is one of a first end and a second end of the first medium in the longitudinal direction, the second separating line comprising a portion formed through or cut in the sheet in the thickness direction, and (vii) a third separating line provided at a second portion of the sheet to which the second medium is stuck, the third separating line being located in the widthwise direction between the center position of the second medium in the widthwise direction and the first end of the second medium in the widthwise direction, the third separating line at least extending in the longitudinal direction between the second endpoint and a second-medium end portion that is one of a first end and a second end of the second medium in the longitudinal direction, wherein a side, with respect to the first endpoint, on which the first-medium end portion is located in the longitudinal direction is identical to a side, with respect to the second endpoint, on which the second-medium end portion is located in the longitudinal direction, the third separating line comprising a portion formed through or cut in the sheet in the thickness direction;

a ribbon roll that is a roll of an ink ribbon to be used for printing on the tape roll; and a housing that houses the tape roll and the ribbon roll.

12. The tape cassette according to claim 11, further comprising:

an opening that exposes the ink ribbon and the tape to an outside of the housing; and an output portion through which the tape exposed to the outside of the housing through the opening is to be passed, wherein a length between the opening and the output portion is less than a distance between two pairs of the plurality of the pairs of the first media and the second media, which two pairs are adjacent to each other in the longitudinal direction.

13. The tape cassette according to claim 11, wherein the second medium comprises an image extending in the longitudinal direction and formed in a first color, and the image is nearer to the second end of the second medium in the widthwise direction than the center position of the second medium in the widthwise direction, and wherein the ink ribbon comprises ink of a second color different from the first color.

* * * * *